US010236587B2

(12) United States Patent
Kim

(10) Patent No.: US 10,236,587 B2
(45) Date of Patent: Mar. 19, 2019

(54) ANTENNA

(71) Applicant: Hyundai Motor Company, Seoul (KR)

(72) Inventor: Dongjin Kim, Seoul (KR)

(73) Assignee: Hyundai Motor Company, Seoul (KR)

( * ) Notice: Subject to any disclaimer, the term of this patent is extended or adjusted under 35 U.S.C. 154(b) by 144 days.

(21) Appl. No.: 14/955,328

(22) Filed: Dec. 1, 2015

(65) Prior Publication Data

US 2017/0098892 A1 Apr. 6, 2017

(30) Foreign Application Priority Data

Oct. 1, 2015 (KR) ..... 10-2015-0138484

(51) Int. Cl.

| | |
|---|---|
| ***H01Q 1/32*** | (2006.01) |
| ***H01Q 13/06*** | (2006.01) |
| ***H01Q 13/10*** | (2006.01) |
| ***H01Q 21/06*** | (2006.01) |

(52) U.S. Cl.

CPC ..... *H01Q 13/06* (2013.01); *H01Q 1/32* (2013.01); *H01Q 13/106* (2013.01); *H01Q 21/064* (2013.01)

(58) Field of Classification Search

CPC ..... H01Q 13/06; H01Q 21/0037; H01Q 21/0043; H01Q 21/005; H01Q 21/064

See application file for complete search history.

(56) References Cited

U.S. PATENT DOCUMENTS

| | | | | |
|---|---|---|---|---|
| 3,701,162 | A * | 10/1972 | Seaton | H01Q 13/20 342/365 |
| 9,660,352 | B2 * | 5/2017 | Oppenlaender | H01Q 21/064 |
| 2005/0146478 | A1 * | 7/2005 | Wang | H01Q 1/288 343/771 |
| 2013/0120205 | A1 * | 5/2013 | Thomson | H01Q 21/0075 343/776 |
| 2016/0079672 | A1 * | 3/2016 | Cerreno | H01Q 21/065 343/848 |

(Continued)

FOREIGN PATENT DOCUMENTS

| | | |
|---|---|---|
| JP | 2005-223836 A | 8/2005 |
| JP | 2008-148149 A | 6/2008 |

(Continued)

*Primary Examiner* — Daniel Munoz

(74) *Attorney, Agent, or Firm* — Mintz Levin Cohn Ferris Glovsky and Popeo, P.C.; Peter F. Corless

(57) ABSTRACT

An antenna having an emission unit emits first and second polarized waves which intersect each other and a supply unit that supplies the first and second polarized waves to the emission unit is provided. The supply unit includes a plurality of cross-shaped coupling apertures that allow first and second slots that the first and second polarized waves are transmitted to intersect and supply the first and second polarized waves to the emission unit. The first and second polarized wave guide directs the first and second polarized waves to the plurality of cross-shaped coupling apertures. The distances from first polarized wave supply slots to the first polarized waves to the first polarized wave guide to the plurality of cross-shaped coupling apertures and from second polarized wave supply slots to the second polarized waves to the second polarized wave guide to the plurality of cross-shaped coupling apertures are respectively about the same.

18 Claims, 25 Drawing Sheets

(56) References Cited

U.S. PATENT DOCUMENTS

2017/0244173 A1* 8/2017 Moon ..... H01Q 21/064

FOREIGN PATENT DOCUMENTS

| | | | |
|---|---|---|---|
| JP | 2008-172703 | A | 7/2008 |
| JP | 2010-239524 | A | 10/2010 |
| KR | 10-1996-0027054 | A | 7/1996 |
| KR | 10-2008-0002725 | A | 1/2008 |
| KR | 10-2009-0024061 | A | 3/2009 |

* cited by examiner

ANTENNA

CROSS-REFERENCE TO RELATED APPLICATION

This application claims the benefit of Korean Patent Application No. 10-2015-0138484, filed on Oct. 1, 2015 in the Korean Intellectual Property Office, the disclosure of which is incorporated herein by reference.

BACKGROUND

1. Field of the Invention

The present invention relates to an antenna, and more particularly, to an antenna using dual-polarized waves.

2. Description of the Related Art

Generally, vehicles use fossil fuel, electricity, etc. as a power source. Recently, in addition to transporting goods and humans, vehicles include audio devices and video devices and navigation devices. Currently, the need for communication between vehicles and external devices is gradually increasing. For example, a navigation function that indicates a path toward a destination requires information related to road traffic conditions to find an optimal path. Since such traffic conditions constantly change, it is necessary for vehicles to obtain information regarding traffic conditions in real time. Additionally, to provide safety and convenience of drivers, forward collision warning systems (FCWS), autonomous emergency braking (AEB) systems, etc. have been developed. Such FCWS or AEB systems may calculate whether a forward vehicle collides or not, an estimated collision time, etc. based on position information of the forward vehicle detected by a radar.

An apparatus for communicating with other vehicles and a radar device for warning of forward collision include an antenna which transmits and receives radio waves. Current vehicle antenna technology is limited to patch array antennas. Typically, antennas are light-weight and thin. However, patch array antennas have a dielectric loss that occurs due to the dielectric substrates and the performance of antennas is reduced due to the dielectric loss. In particular, fifth generation communication or radars typically use high frequency of several tens of GHz or greater, efficiency of patch antennas does not reach 30%. Additionally, since patch array antennas use a serial type feeding structure, narrow frequency band properties are available.

SUMMARY

Therefore, the present invention provides an antenna which has minimal loss in a millimeter wave band, has high directivity and improves a providable data transfer rate. Additional aspects of the invention will be set forth in part in the description which follows and, in part, will be obvious from the description, or may be learned by practice of the invention.

In accordance with one aspect of the present invention, an antenna may include an emission unit configured to emit first and second polarized waves which intersect each other and a supply unit configured to generate the first and second polarized waves to the emission unit. Further, the supply unit may include a plurality of cross-shaped coupling apertures formed by intersection of first slots through which the first polarized waves are transmitted and second slots through which the second polarized waves are transmitted and supply the first and second polarized waves to the emission unit, a first polarized wave guide which guides the first polarized waves to the plurality of cross-shaped coupling apertures, and a second polarized wave guide which guides the second polarized waves to the plurality of cross-shaped coupling apertures. For example, distances from first polarized wave supply slots that supply the first polarized waves to the first polarized wave guide to the plurality of cross-shaped coupling apertures are about the same (e.g., identical) and distances from second polarized wave supply slots which supply the second polarized waves to the second polarized wave guide to the plurality of cross-shaped coupling apertures are about the same (e.g., identical).

The first polarized wave guide and the second polarized wave guide may be formed from different layers. The second polarized wave guide may include a plurality of second polarized wave supply guides that may direct the second polarized waves to the plurality of cross-shaped coupling apertures and a second polarized wave distribution guide which distributes the second polarized waves to the plurality of second polarized wave supply guides. The second polarized wave supply guides and the second polarized wave distribution guide may be formed from different layers. The second polarized wave supply guides may be disposed positions that correspond to an end of the first polarized wave guide. Ends of the second polarized wave supply guides may extend about one fourth of the wavelengths of the first and second polarized waves from the end of the first polarized wave guide. Widths of the second polarized wave supply guides and the first polarized wave guide may be about one half of wavelengths of the first and second polarized waves, and widths of areas in which the second polarized wave supply guides and the first polarized wave guide may overlap may be about three fourths of the wavelengths of the first and second polarized waves.

First coupling slots that supply the first polarized waves to the plurality of cross-shaped coupling apertures through the plurality of second polarized wave supply guides may be formed at a plurality of ends of the first polarized wave guide. Cross-shaped coupling slots that supply the first polarized waves and the second polarized waves to the plurality of cross-shaped coupling apertures may be formed at ends of the plurality of second polarized wave supply guides. The emission unit may include a plurality of emission cavities with a plurality of cross-shaped emission slots that transmit (e.g., emit) the first and second polarized waves. The plurality of emission cavities may correspond to the plurality of cross-shaped coupling apertures.

In another aspect of the present invention, an antenna may include an emission unit configured to transmit first and second polarized waves which intersect each other and a supply unit configured to generate the first and second polarized waves to the emission unit. For example, the emission unit may include a plurality of emission cavities with a plurality of cross-shaped emission slots which emit the first and second polarized waves, respectively. The emission cavities may each include the four cross-shaped emission slots. The supply unit may include a plurality of cross-shaped coupling apertures formed by allowing first slots through which the first polarized waves are transmitted and second slots through which the second polarized waves are transmitted to intersect each other. Further, the first and second polarized waves may be supplied to the emission unit through a first polarized wave guide which guides the first polarized waves to the plurality of cross-shaped coupling apertures, and a second polarized wave guide which guides the second polarized waves to the plurality of cross-shaped coupling apertures.

In accordance an aspect of the present invention, an antenna having a plurality of metal layers may include an emission layer configured to generate first and second polarized waves and a supply layer configured to transmit the first and second polarized waves to the emission layer. Herein, the emission layer may include a first emission layer with a plurality of cross-shaped emission slots which emit the first and second polarized waves, a second emission layer with emission cavities disposed to correspond to the plurality of cross-shaped emission slots, and a third emission layer with cross-shaped coupling slots which supply the first and second polarized waves to the emission cavities.

The supply layer may include a first polarized wave supply layer with a first polarize wave guide which guides the first polarized waves to the cross-shaped coupling slots and a second polarized wave supply layer with a second polarized wave guide which guides the second polarized waves to the cross-shaped coupling slots. The second polarized wave supply layer may include a third polarized wave supply layer with a second polarized wave supply guide which supplies the second polarized waves to the plurality of cross-shaped coupling apertures. Further, a fourth polarized wave supply layer with a second polarized wave distribution guide may distributes the second polarized waves to the second polarized wave supply guide.

In accordance an aspect of the present invention, an antenna may include an emission unit configured to generate plurality of polarized waves which intersect each other and a supply unit configured to generate the plurality of polarized waves to the emission unit. In particular, the supply unit may include a plurality of coupling apertures which supply the plurality of polarized waves to the emission unit and a plurality of polarized wave guides which guide the plurality of respective polarized waves to the plurality of coupling apertures. Additionally, distances from polarized wave supply slots which supply the polarized waves to the plurality of polarized wave guides to the plurality of coupling apertures may be about the same. The plurality of respective polarized wave guides may be formed on different layers. The emission unit may include a plurality of emission cavities with a plurality of cross-shaped emission slots configured to generate the plurality of polarized waves. The plurality of emission cavities may correspond to the plurality of coupling apertures.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor. The memory is configured to store the modules and the processor is specifically configured to execute said modules to perform one or more processes which are described further below.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Figure 1:
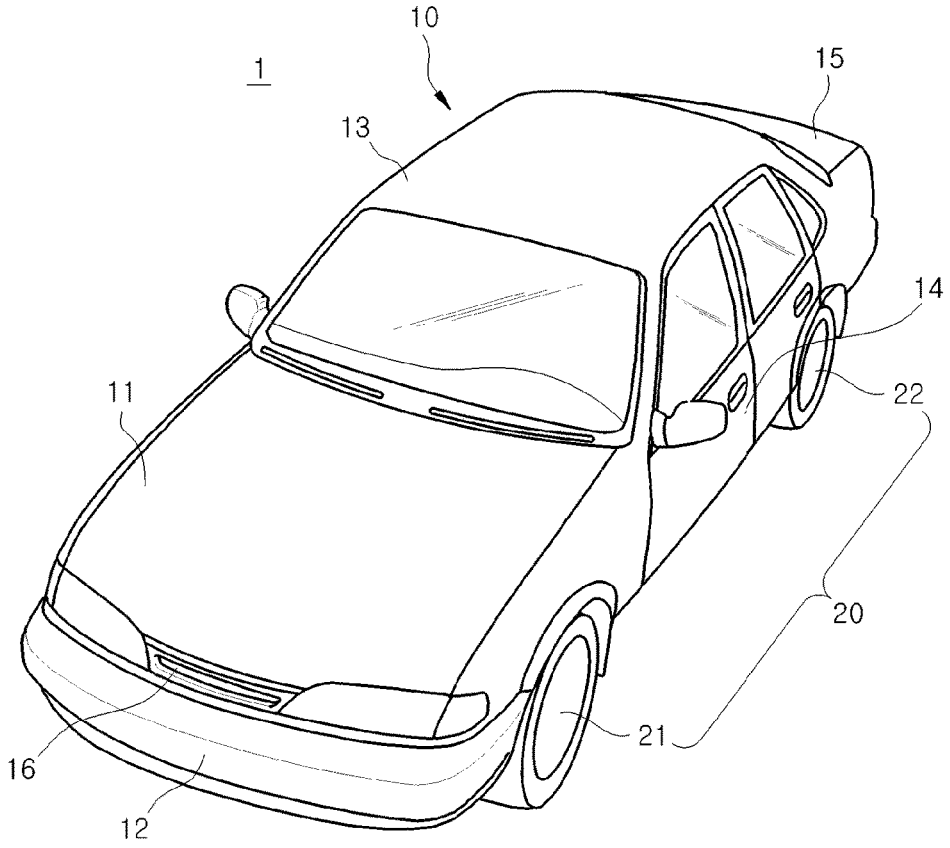
FIG. 1 illustrates an exemplary a vehicle body of a vehicle in accordance with an exemplary embodiment of the present invention.
Figure 2:
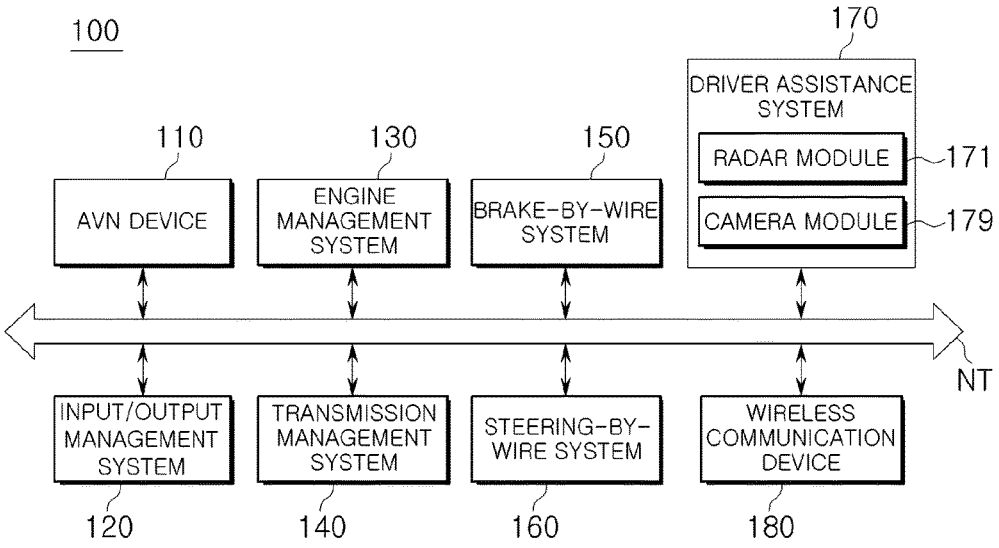
FIG. 2 illustrates exemplary electronic devices within the vehicle in accordance with an exemplary embodiment of the present invention.

One exemplary embodiment of the present invention will be described in detail with reference to the attached drawings. FIG. 1 illustrates a vehicle body 10 of a vehicle 1 in accordance with an exemplary embodiment of the present invention. FIG. 2 illustrates electronic devices 100 that may be included in the vehicle 1. The vehicle 1 may include the vehicle body 10 which forms an exterior, wheels 20 which move the vehicle 1, a power system (not shown) which generates torque for rotating the wheels 20, a power train system (not shown) which transfers the torque generated by the power system to the wheels 20 while adjusting a speed. Further a steering system (not shown) which adjusts a movement direction of the vehicle 1, a brake system (not shown) which stops (e.g., reduces) rotation of the wheels 20, a suspension system (not shown) which reduces vibrations of the vehicle 1, and the electronic devices 100 which electrically operate respective components included within the vehicle 1 may be included.

The vehicle body 10 may include a hood 11, a front bumper 12, a roof panel 13, doors 14, a trunk lid 15, a radiator grille 16, etc. The power system may include an engine, a fuel system, a cooling system, an exhaust, an ignition, etc. The power train system may include a clutch, a transmission, a differential gear, a driving shaft, etc. The steering system may include a steering wheel, a steering gear, a steering link, etc. The brake system may include a brake disk, a brake pad, a master cylinder, etc. The suspension system may include a shock absorber, etc. The vehicle 1 may include the various electronic devices 100 together with the mechanical devices described above.

As shown in FIG. 2, the vehicle 1 may include an audio/video/navigation (AVN) device 110, an input/output management system 120, an engine management system (EMS) 130, a transmission management system (TMS) 140, a brake-by-wire system 150, a steering-by-wire system 160, a driver assistance system (DAS) 170, a wireless communication device 180, etc. As further shown in FIG. 2, the electronic devices 100 are merely a part of the electronic devices included in the vehicle 1 and additional electronic devices may be disposed within the vehicle 1. Additionally, the vehicle 1 may omit part of the electronic devices 100 shown in FIG. 2.

The electronic devices 100 included within the vehicle 1 may communicate with one another via a vehicle communication network (NT). The vehicle communication network (NT) may employ communication protocols such as a media oriented systems transport (MOST) that may have a communication speed a maximum of about 24.5 mega-bits per second (Mbps), a FlexRay which has a communication speed maximum of about 10 Mbps, a controller area network (CAN) which has a communication speed of from about 125 kilo-bits per second (kbps) to about 1 Mbps, a local interconnect network (LIN) which has a communication speed of about 20 kbps, etc. The vehicle communication network NT described above may not be limited to a single communication protocol such as MOST, FlexRay, CAN, LIN, etc. but also a plurality of communication protocols. The AVN device 110 outputs music or images according to a control command of a driver. In particular, the AVN device 110 may play music or videos or may guide a path to a destination based on the control command of the driver.

The input and output management system 120 may be configured to receive the control command of the driver through a button and display information that corresponds to the control command of the driver. The input and output management system 120 may include a cluster display disposed in a dashboard and may be configured to display a vehicle speed, an engine rotational speed, a lubrication amount, etc. and a wheel button module installed on the steering wheel.

The EMS 130 may be configured to perform fuel injection management, gas mileage feedback management, lean-burn management, ignition timing management, idle revolutions per minute (rpm) management, etc. The EMS 130 may include a plurality of devices connected through communication. The TMS 140 may perform shifting point management, damper clutch management, management of a pressure when turning on and off a frictional clutch, engine torque management while adjusting speed, etc. The TMS 140 may include a plurality of devices connected via communication. The brake-by-wire system 150 may be configured to manage a brake of the vehicle 1, and representatively, may include an anti-lock brake system (ABS), etc. The steering-by-wire system 160 may be configured to reduce a steering force while driving at a low speed or parking and increase the steering force while driving at a high speed, thereby assisting the driver with a steering operation.

The driver assistance system 170 may be configured to assist the vehicle 1 with driving and perform functions that may include a forward collision avoidance function, a lane departure warning function, a blind spot detection function, a rear sensing function, etc. The driver assistance system 170 may include a plurality of devices connected via communication. For example, the driver assistance system 170 may include a forward collision warning system (FCWS), an advanced emergency braking system (AEBS), an adaptive cruise control (ACC) system, a lane departure warning system (LDWS), a lane keeping assist system (LKAS), a blind spot detection (BSD) system, a rear-end collision warning system (RCWS), etc.

The driver assistance system 170 may include a radar module 171 configured to detect positions of vehicles in front or rear side and an imaging device 179 configured to obtain images of forward and rear vehicles. In particular, the radar module 171 may be used in systems that operate based on the positions of forward and rear vehicles, such as the FCWS, the AEBS, the ACC system, the BSD system, the RCW, etc. Additionally, the imaging device 179 may be used in systems that operate based on images of forward and rear vehicles and roads, such as the LDWS and the LKAS, etc.

Figure 3:
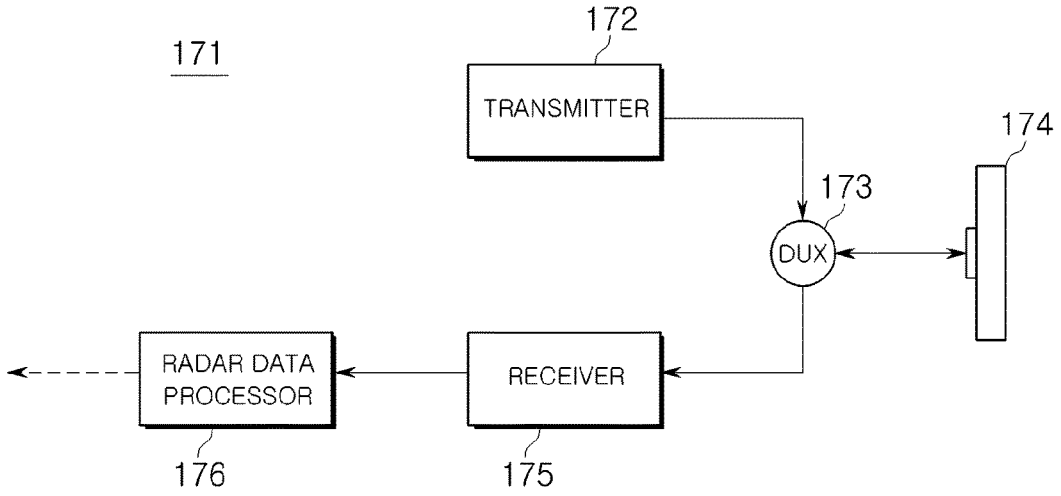
FIG. 3 is an exemplary configuration diagram of a radar device included in the vehicle in accordance with an exemplary embodiment of the present invention.

In particular, the radar module 171, as shown in FIG. 3, may include a transmitter 172, a duplexer 173, an antenna 174, a receiver 175, and a radar data processor 176. The transmitter 172 may be configured to generate a transmission signal having a radio frequency (RF) using an RF signal of a local oscillator and may be configured to output the generated transmission signal. The duplexer 173 may provide the transmission signal having the RF received from the transmitter 172 to the antenna 174 or may provide a reflection signal having the RF received from the antenna 174 to the receiver 175. The antenna 174 may be configured to emit a radar signal received from the duplexer 173 into a free air space and provide the reflection signal received from the free air space to the duplexer 173. The receiver 175 may be configured to extract radar data from the reflection signal received from the duplexer 173 using the RF signal of the local oscillator. The radar data processor 176 may be configured to process the radar data received from the receiver 175 and extract location information of an object. As described above, the radar module 171 may be configured to emit the transmission signal having the RF into the free air space through the antenna 174 and obtain a reflection signal received from the object through the antenna 174, to calculate the position information of the object.

Figure 4:
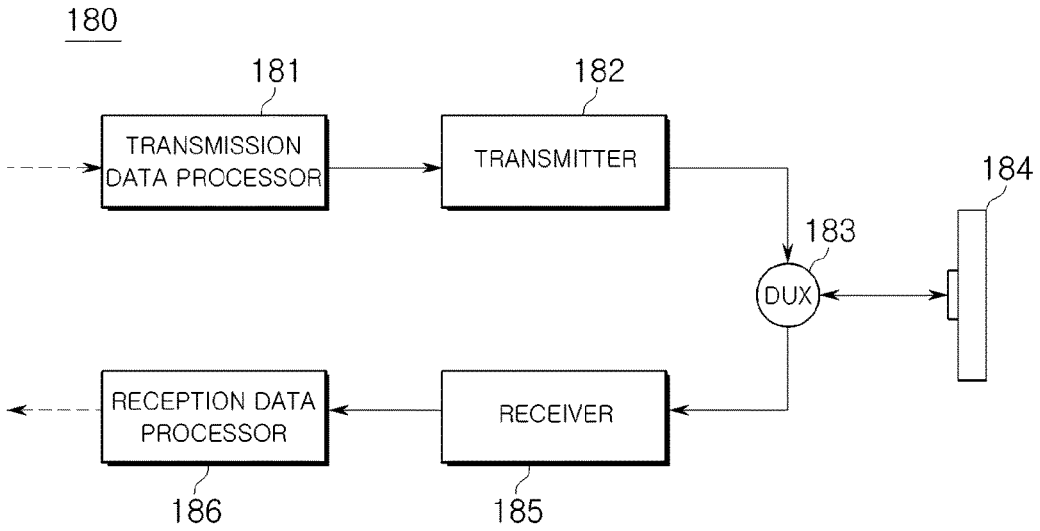
FIG. 4 is an exemplary configuration diagram of a wireless communication device included within the vehicle in accordance with an exemplary embodiment of the present invention.

The wireless communication device 180 may be configured to communicate with another vehicle, an external terminal, or a communication repeater. The wireless communication device 180 may be configured to transmit and receive signals via various communication protocols. For example, the wireless communication device 180 may employ a second generation (2G) communication method including time division multiple access (TDMA), code division multiple access (CDMA), etc., a third generation (3G) communication method such as wide code division multiple access (WCDMA), code division multiple access 2000 (CDMA2000), Wireless Broadband (WiBro), Worldwide Interoperability for Microwave Access (WiMAX), etc., and a fourth generation (4G) communication method such as Long Term Evolution (LTE), WiBro Evolution, etc. Additionally, the wireless communication device 180 may employ a fifth generation (5G) communication method. The wireless communication device 180, as shown in FIG. 4, may include a transmission data processor 181, a transmitter 182, a duplexer 183, an antenna 184, a receiver 185, and a reception data processor 186.

The transmission data processor 181 may be configured to convert digital transmission data received from another electronic device into a transmission signal having a low frequency (LF) and provide the converted transmission signal having the LF to the transmitter 182. The transmitter 182 may be configured to modulate the transmission signal having the LF into a transmission signal having an RF using an RF signal of a local oscillator and output the modulated transmission signal having the RF. The duplexer 183 may be configured to provide the transmission signal having the RF received from the transmitter 182 to the antenna 184 or provides a reception signal having an RF received from the antenna 184 to the receiver 185.

The antenna 184 may be configured to emit the transmission signal having the RF received from the duplexer 183 into a free air space and provide the reception signal having the RF received from the free air space to the duplexer 183. The receiver 185 may be configured to demodulate the reception signal having the RF received from the duplexer 183 using the RF signal of the local oscillator and output the demodulated reception signal having an LF. The reception data processor 186 may be configured to convert the reception signal having the LF received from the receiver 185 into digital reception data and output the converted digital reception data. As described above, the wireless communication device 180 may be configured to transmit a transmission signal having an RF to an external device through the antenna 184 and receives a reception signal having an RF transmitted from the external device through the antenna 184.

Typically, the radar module 171 and the wireless communication device 180 include the antennas 174 and 184. The antenna 174 of the radar module 171 and the antenna 184 of the wireless communication device 180 have substantially identical structures and functions. Additionally, the performance of the radar module 171 and the wireless communication device 180 is based on properties of the antennas 174 and 184. In particular, when millimeter waves having a frequency from about 30 to about 300 GHz and a wavelength from about 10 to about 1 mm are used, the performance of the radar module 171 and the wireless communication device 180 is based on the properties of the antennas 174 and 184 and an array antenna may be used to improve the performance of the antennas 174 and 184.

Figure 5:
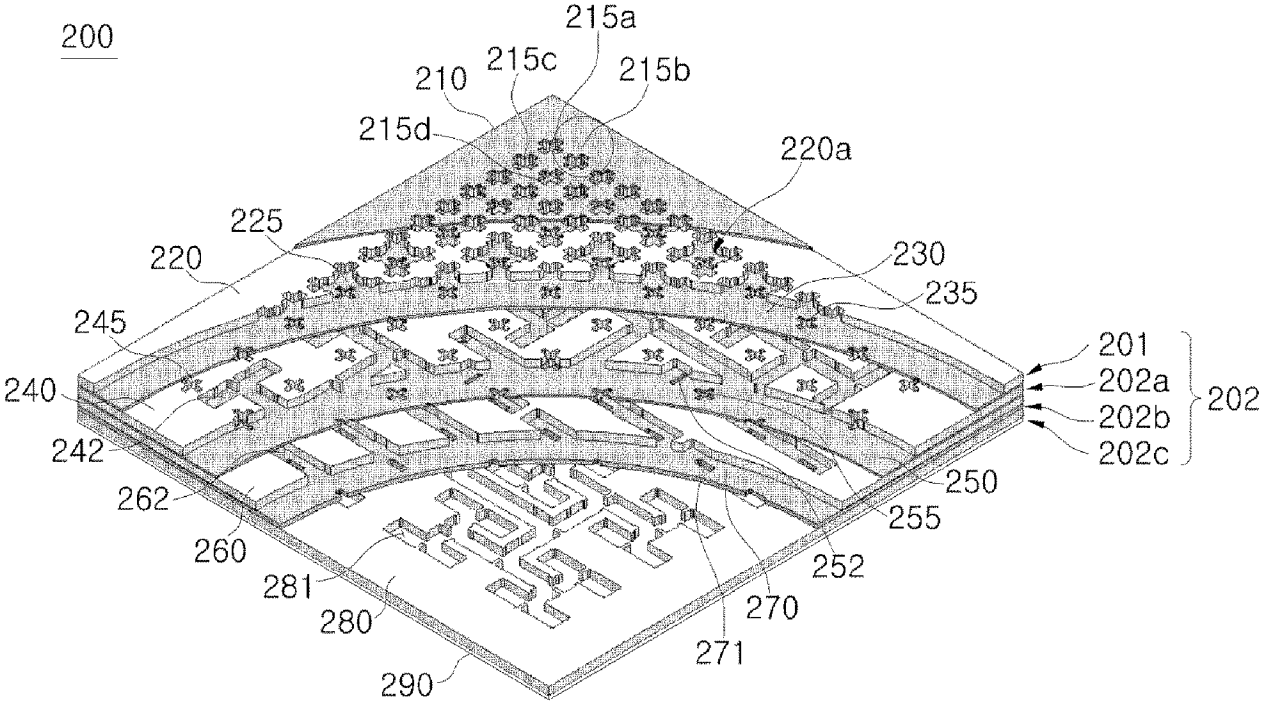
FIG. 5 illustrates an exemplary antenna in accordance with an exemplary embodiment of the present invention.

Hereinafter, an antenna 200 mounted within the vehicle 1 in accordance with an exemplary embodiment of the present invention will be described. FIG. 5 illustrates the antenna 200. FIGS. 6 to 14 illustrate a first plate to a ninth plate that may be included in the antenna 200 in accordance an exemplary embodiment respectively. FIG. 15 illustrates a part of a wave guide formed in the antenna 200. The antenna 200 may be configured to emit a frequency into a free air space and receive a frequency from the free air space. The antenna 200 may be installed in various positions according to use. For example, the antenna 200 for radar may be installed in the radiator grille 16 (refer to FIG. 1) of the vehicle 1 and the antenna 200 for wireless communication may be installed in the roof panel 13 (refer to FIG. 1) of the vehicle 1.

Referring to FIGS. 5 to 15, the antenna 200 may include a plurality of cross-shaped emission slots 215*a*, 215*b*, 215*c*, and 215*d* to emit frequencies at an uppermost part. The respective cross-shaped emission slots 215*a*, 215*b*, 215*c*, and 215*d* may be formed in a cross shape to emit polarized waves in an x-axis direction (hereinafter, referred to as x-axis-polarized waves) and polarized waves in a y-axis direction (hereinafter, referred to as y-axis-polarized waves) based on a coordinate axis shown in FIG. 5. The antenna 200 may structurally include four layers 201, 202*a*, 202*b*, and 202*c* and may include nine plates 210 to 290 with a plurality of slots to form the four layers 201, 202*a*, 202*b*, and 202*c*.

The nine plates 210 to 290, as shown in FIG. 5, may be stacked (e.g., arranged in a layered pattern) in a z-axis direction vertical to the cross-shaped emission slots 215*a*, 215*b*, 215*c*, and 215*d*. The nine plates 210 to 290 may be formed of a conductor such as a metal through which currents flow to form wave guides in the respective four layers 201, 202*a*, 202*b*, and 202*c*. Additionally, the antenna 200 may include an emission unit 201 configured to emit frequencies and supply units 202 (202*a*, 202*b*, and 202*c*) (refer to FIG. 5) configured to supply x-axis-polarized waves and y-axis-polarized waves to the emission unit 201.

The emission unit 201 may be configured to receive the x-axis-polarized waves and y-axis-polarized waves from the supply unit 202 and uniformly distribute and emit the received x-axis-polarized waves and y-axis-polarized waves to the four cross-shaped emission slots 215*a*, 215*b*, 215*c*, and 215*d* and into a free air space. The emission unit 201 may include an emission cavity 220*a* formed with the cross-shaped emission slots 215*a*, 215*b*, 215*c*, and 215*d* which emit the x-axis-polarized waves and y-axis-polarized waves into the free air space. The emission cavity 220*a* may be formed by a first plate 210, a second plate 220, and a third plate 230.

Figure 8:
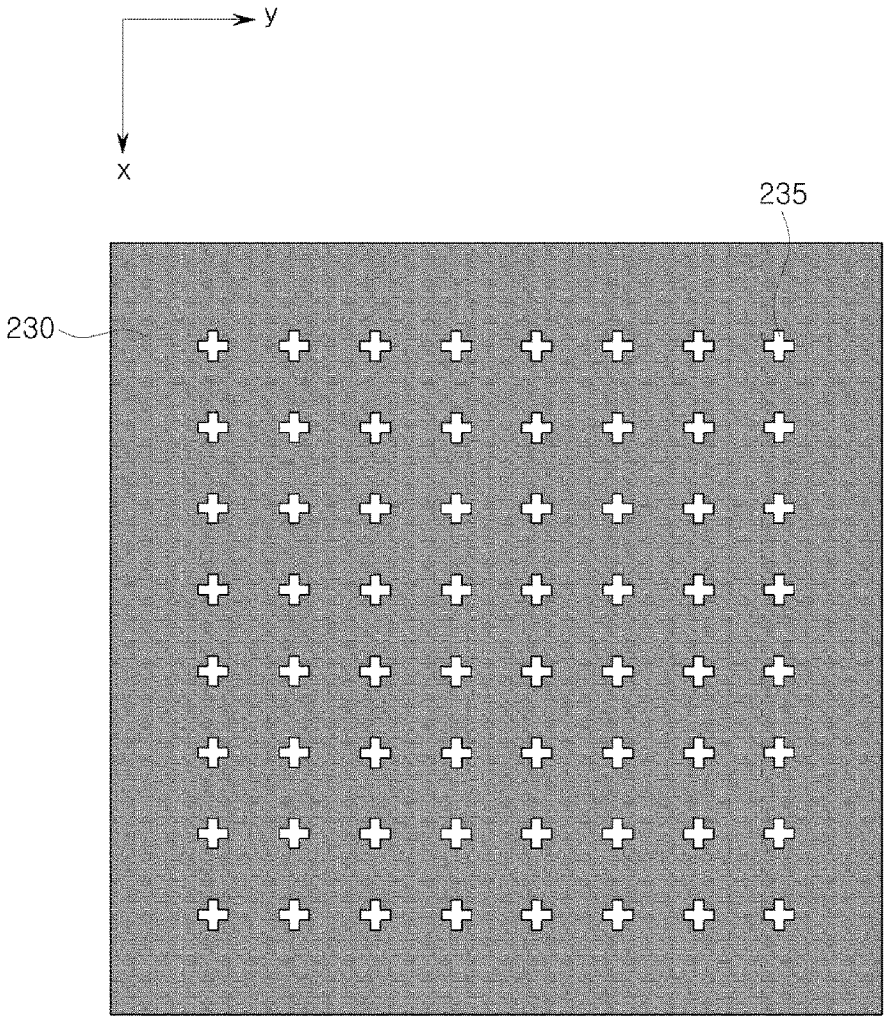

The third plate 230, as shown in FIG. 8, may include a plurality of first cross-shaped coupling slots 235 that may be uniformly formed. The plurality of first cross-shaped coupling slots 235 are a part of cross-shaped coupling apertures 255, 245, and 235 that supply the x-axis-polarized waves and y-axis-polarized waves from the supply unit 202 to the emission unit 201. The x-axis-polarized waves and y-axis-polarized waves may be supplied to the emission unit 201 through the first cross-shaped coupling slots 235 of the third plate 230.

Figure 6:
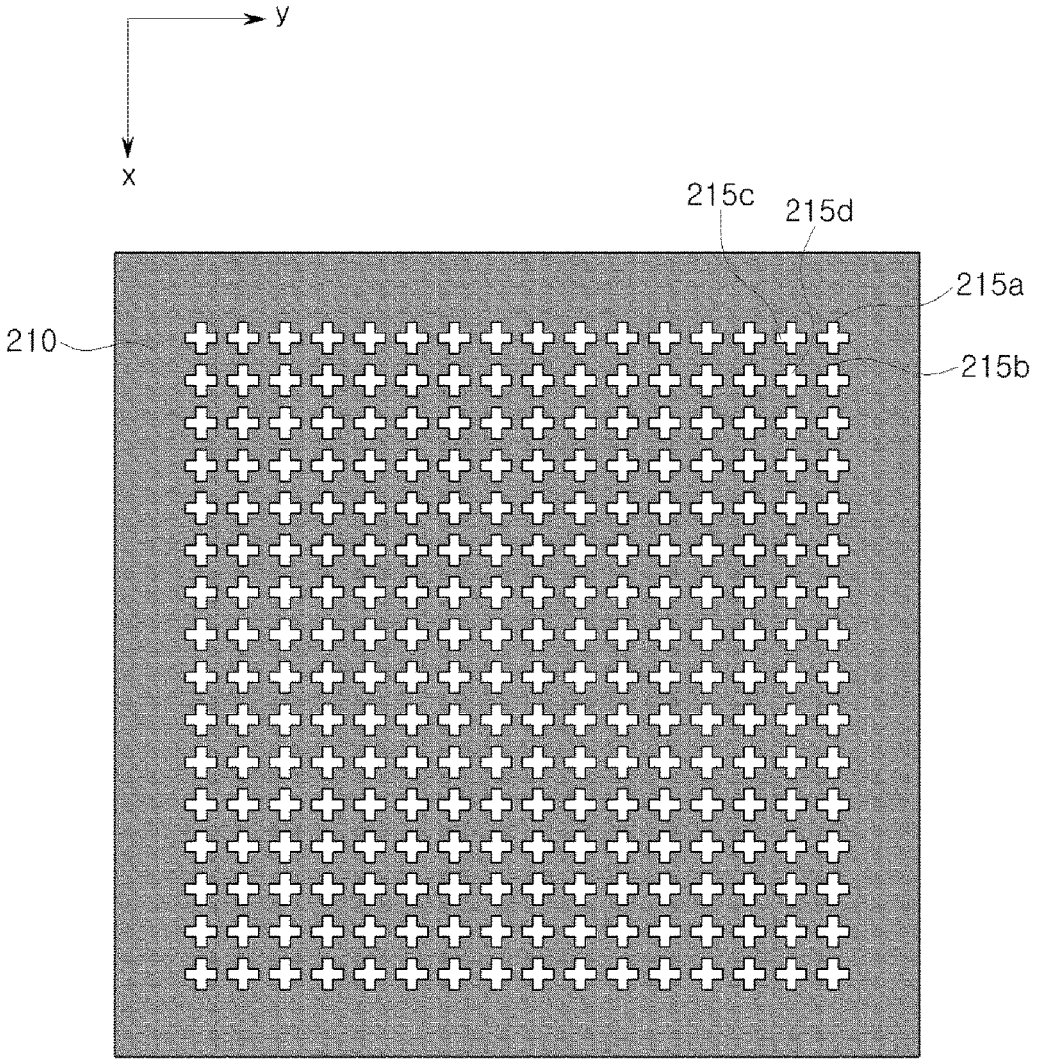
FIGS. 6 to 14 illustrate an exemplary first plate to a ninth plate included in the antenna in accordance with an exemplary embodiment of the present invention, respectively.
Figure 7:
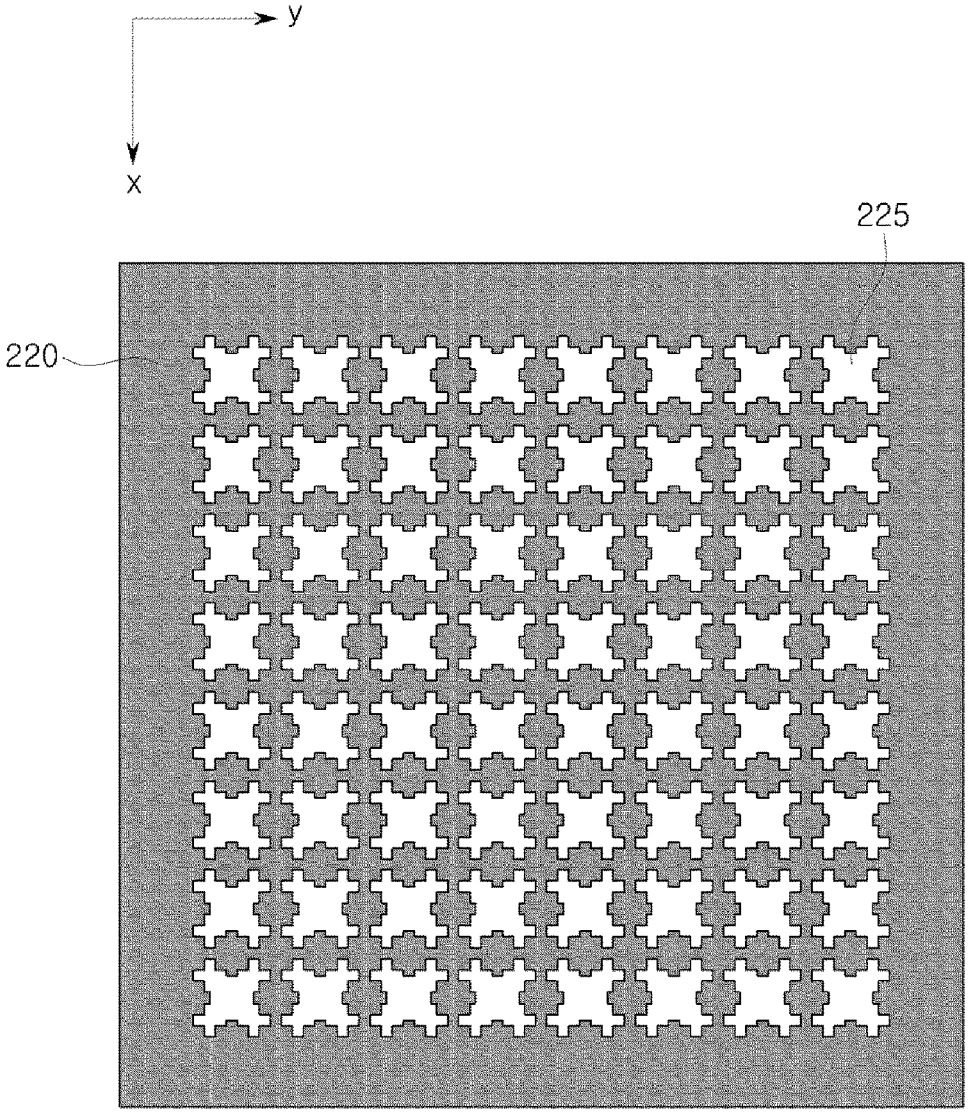

Further, the second plate 220, as shown in FIG. 7, may include a plurality of emission cavity-forming slots 225 which are uniformly formed to form the emission cavity 220*a*. The emission cavity-forming slots 225 of the second plate 220 may be formed having the same number as the first cross-shaped coupling slots 235 of the third plate 230. Additionally, the first plate 210, as shown in FIG. 6, may include a plurality of cross-shaped emission slots 215*a*, 215*b*, 215*c*, and 215*d* which are uniformly formed and emit the x-axis-polarized waves and y-axis-polarized waves. The emission cavity 220*a* may match the impedance values between the free air space and the antenna 200 and may include the third plate 230 which forms a bottom surface, the second plate 220 which forms a side surface, and the first plate 210 which forms a top surface.

The x-axis-polarized waves and y-axis-polarized waves may be induced in the emission cavity 220*a* due to the x-axis-polarized waves and y-axis-polarized waves supplied through the first cross-shaped coupling slots 235 of the third plate 230. The x-axis-polarized waves and y-axis-polarized waves in the emission cavity 220*a* may be emitted into the free air space through the cross-shaped emission slots 215*a*, 215*b*, 215*c*, and 215*d* of the first plate 210. For example, the number of the cross-shaped emission slots 215*a*, 215*b*, 215*c*, and 215*d* of the first plate 210 may be four times greater than the number of the emission cavity-forming slots 225 of the second plate 220 and the first cross-shaped coupling slots 235 of the third plate 230. In other words, a ratio of the number of the first cross-shaped coupling slots 235 of the third plate 230 to the cross-shaped emission slots 215*a*, 215*b*, 215*c*, and 215*d* of the first plate 210 is about 1:4. Additionally, the emission cavity 220*a* of the emission unit 201 may uniformly distribute the x-axis-polarized waves and y-axis-polarized waves supplied through the one first cross-shaped coupling slot 235 to the four cross-shaped emission slots 215*a*, 215*b*, 215*c*, and 215*d*.

As described above, the x-axis-polarized waves and y-axis-polarized waves supplied through the one first cross-shaped coupling slot 235 may be uniformly distributed to the four cross-shaped emission slots 215*a*, 215*b*, 215*c*, and 215*d* to increase the density of the cross-shaped emission slots 215*a*, 215*b*, 215*c*, and 215*d* which emit the x-axis-polarized waves and y-axis-polarized waves four times and a distance therebetween may be reduced by half. As described above, the distance between the cross-shaped emission slots 215*a*, 215*b*, 215*c*, and 215*d* which emit the x-axis-polarized waves and y-axis-polarized waves may be reduced, thereby improving directionality of waves emitted by the antenna 200. In other words, the antenna 200 may include a main lobe having a sharp shape in the z-axis direction and a minimized side lobe.

The supply unit 202 may include the cross-shaped coupling apertures 255, 245, and 235 which guide the x-axis-polarized waves and y-axis-polarized waves to the emission unit 201, an x-axis-polarized wave guide 280*a* which guides the x-axis-polarized waves to the cross-shaped coupling apertures 255, 245, and 235, and y-axis-polarized wave guides 240*a* and 260*a* which guide the y-axis-polarized waves to the cross-shaped coupling apertures 255, 245, and 235. The x-axis-polarized wave guide 280*a* may be formed by a seventh plate 270, an eighth plate 280, and a ninth plate 290. The ninth plate 290, as shown in FIG. 14, may include an x-axis-polarized wave supply slot 291 that may supply the x-axis-polarized waves to the x-axis-polarized wave guide 280*a* from an external device and a first y-axis-polarized wave supply slot 292 which forms y-axis-polarized wave supply apertures 292, 282, 272, 262, and 252 which supply the y-axis-polarized waves to the y-axis-polarized wave guides 240*a* and 260*a* from the external device.

Figure 13:
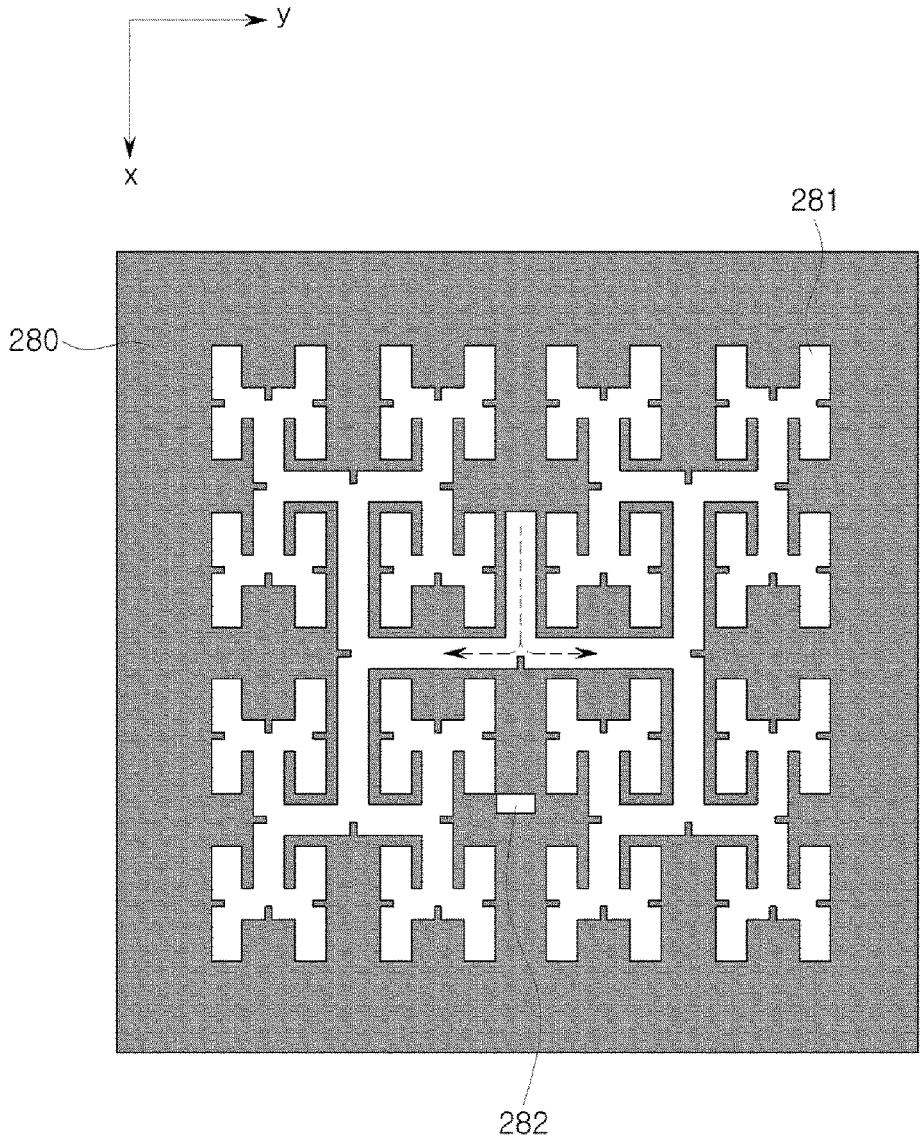

The eighth plate 280, as shown in FIG. 13, may include x-axis-polarized wave guide-forming slots 281 to form the x-axis-polarized wave guide 280*a* and a second y-axis-polarized wave supply slot 282 which forms the y-axis-polarized wave supply apertures 292, 282, 272, 262, and 252 which supply the y-axis-polarized waves to the y-axis-polarized wave guides 240*a* and 260*a*. For example, the widths of the x-axis-polarized wave guide-forming slots 281 may be about the same as half wave ($\lambda/2$) of the x-axis-polarized waves. In other words, a width of the x-axis-polarized wave guide 280*a* may be about the same to half wave ($\lambda/2$) of the x-axis-polarized waves and may depend on frequencies and wavelengths of the emitted x-axis-polarized waves.

Figure 12:
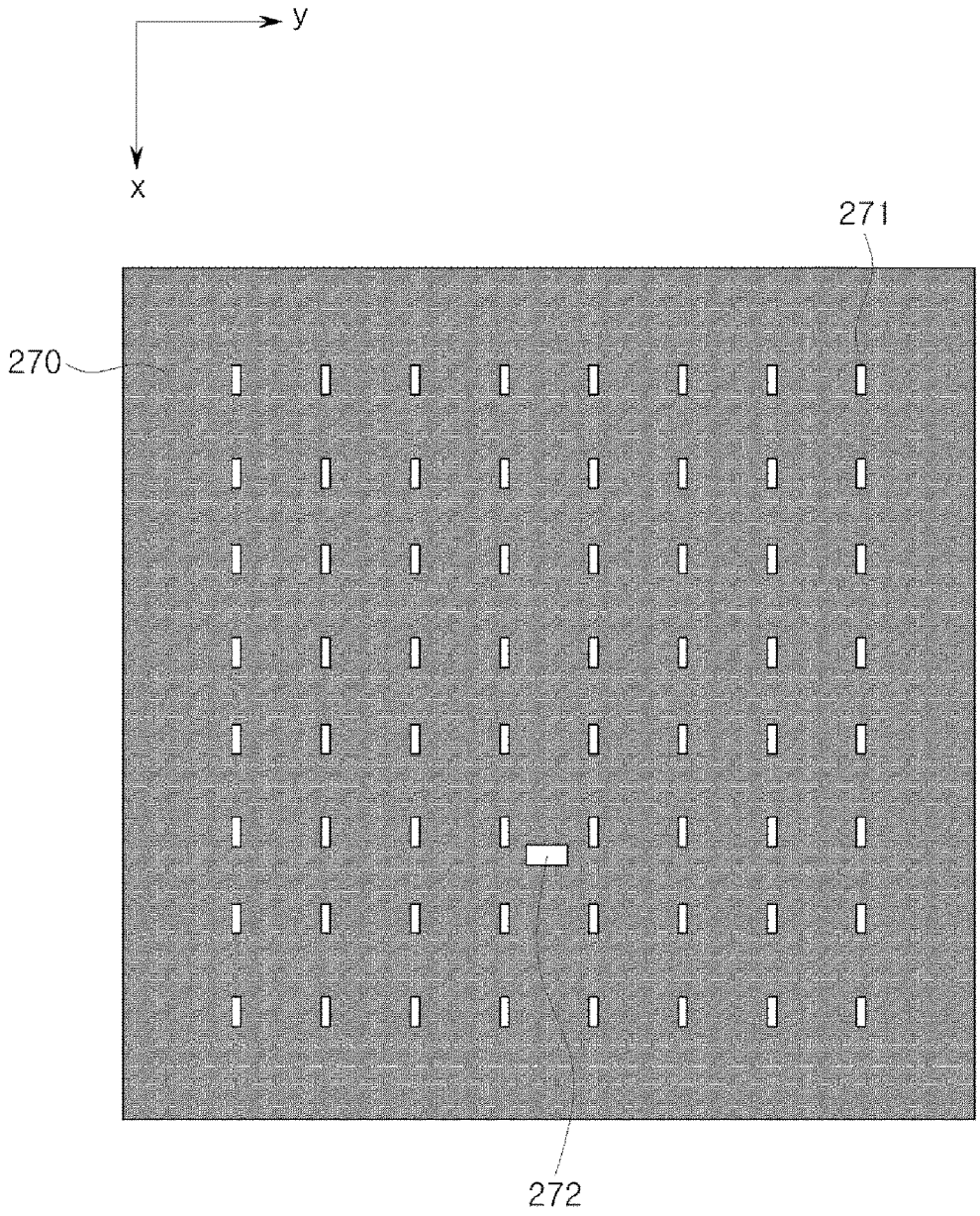

The seventh plate 270, as shown in FIG. 12, may include x-axis-polarized wave coupling slots 271 which supply the x-axis-polarized waves of the x-axis-polarized wave guide 280*a* to the cross-shaped coupling apertures 255, 245, and 235 and a third y-axis-polarized wave supply slot 272 which forms the y-axis-polarized wave supply apertures 292, 282, 272, 262, and 252 which supply the y-axis-polarized waves to the y-axis-polarized wave guides 240*a* and 260*a*. The x-axis-polarized wave guide 280*a* may guide the x-axis-polarized waves supplied through the x-axis-polarized wave supply slot 291 to the x-axis-polarized wave coupling slots 271. The x-axis-polarized waves guided to the x-axis-polarized wave coupling slots 271 may be supplied to the cross-shaped coupling apertures 255, 245, and 235 and may be supplied to the emission cavity 220*a* through the cross-shaped coupling apertures 255, 245, and 235.

Figure 14:
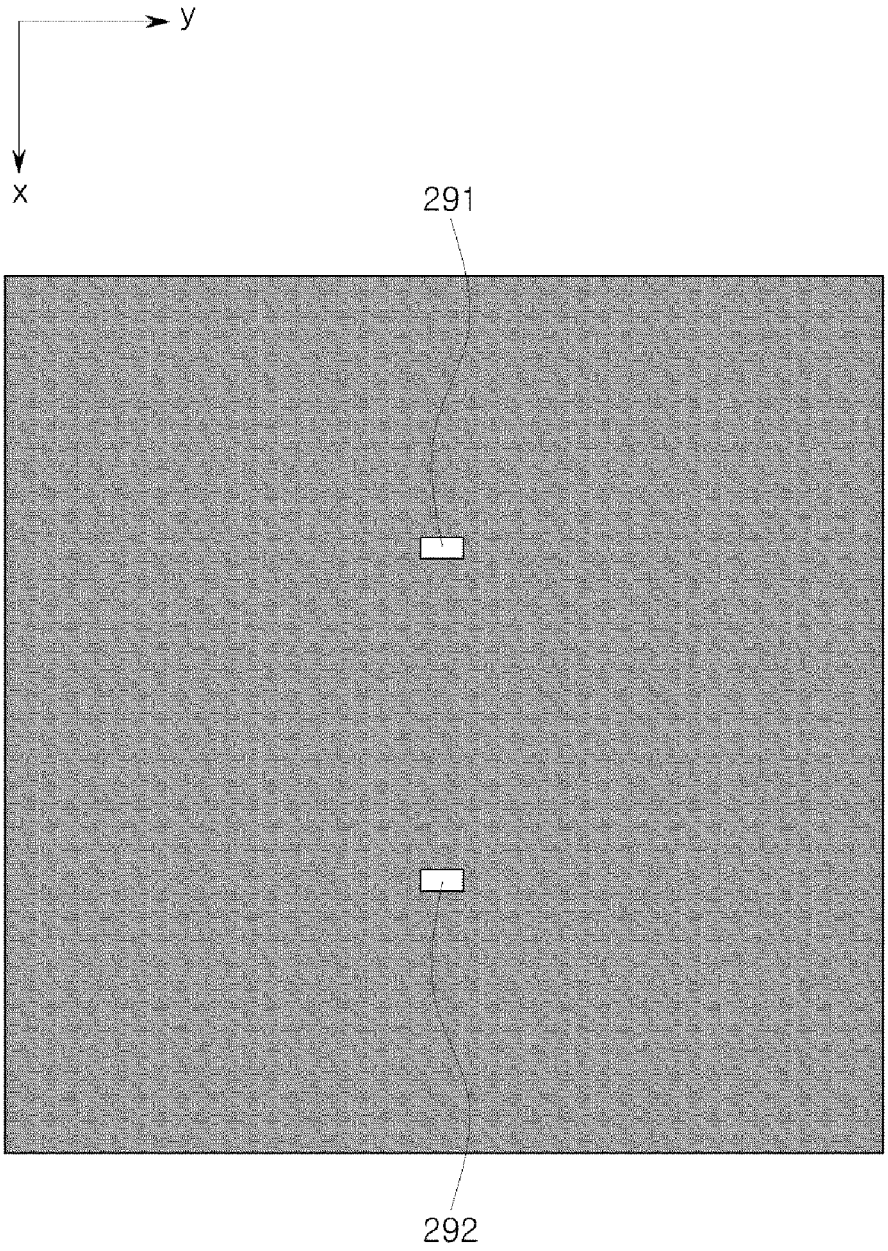
Figure 15:
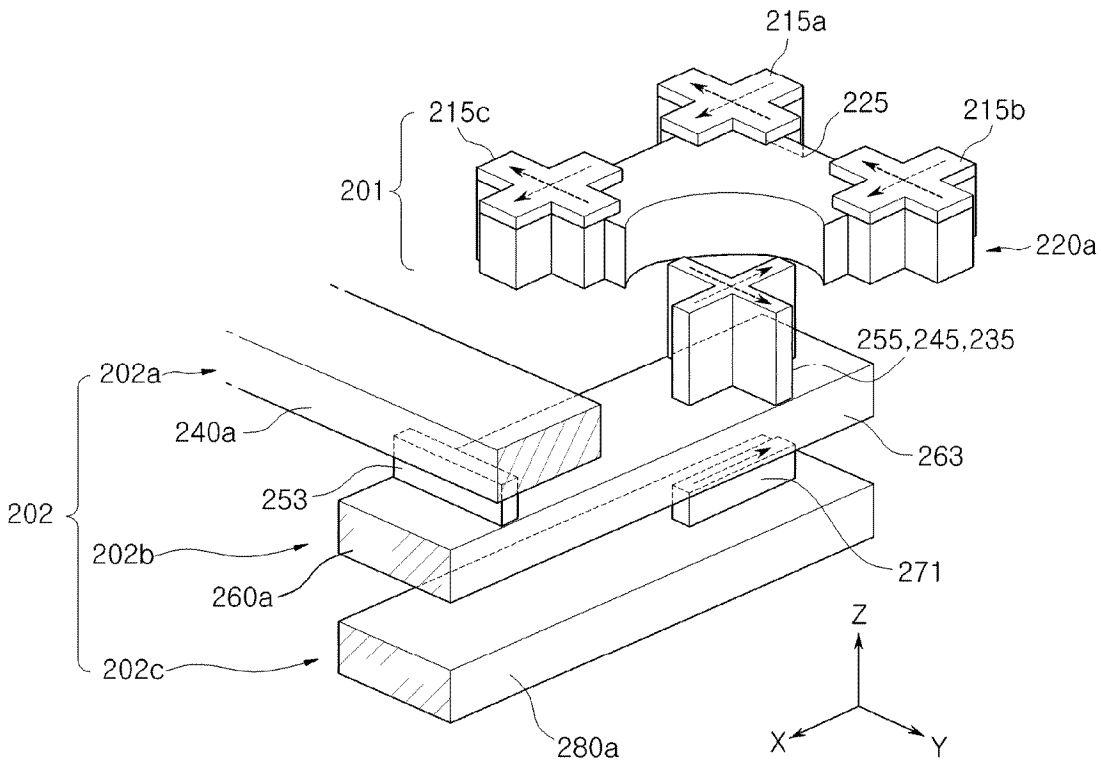
FIG. 15 illustrates an exemplary part of a wave guide formed in the antenna in accordance with an exemplary embodiment of the present invention.

Referring to FIGS. 12, 13, and 14, the x-axis-polarized wave guide 280*a* may uniformly extend from a center of the antenna 200 to every portions of the antenna 200. Additionally, the x-axis-polarized wave supply slot 291 may be formed in a center of the x-axis-polarized wave guide 280*a* and the x-axis-polarized wave coupling slots 271 may be formed at an end of the x-axis-polarized wave guide 280*a*. As a result, the x-axis-polarized waves may be transmitted from the x-axis-polarized wave supply slot 291 to a plurality of x-axis-polarized wave coupling slots 271 along the x-axis-polarized wave guide 280*a*. Additionally, lengths of paths which extend from the x-axis-polarized wave supply slot 291 to the plurality of x-axis-polarized wave coupling slots 271 along the x-axis-polarized wave guide 280*a* may be about the same. In other words, distances in which the x-axis-polarized waves are transmitted from the x-axis-polarized wave supply slot 291 to the plurality of x-axis-polarized wave coupling slots 271 along the x-axis-polarized wave guide 280*a* may be about the same.

As a result, the x-axis-polarized waves supplied to the cross-shaped coupling apertures 255, 245, and 235 through the plurality of such x-axis-polarized wave coupling slots 271 may include identical phases and amplitudes. In other words, the x-axis-polarized waves supplied to the cross-shaped coupling apertures 255, 245, and 235 may have the same phases and amplitudes regardless of a position of the antenna 200. The y-axis-polarized wave guides 240*a* and

260*a* may include a first y-axis-polarized wave guide 240*a* which receives the y-axis-polarized waves from the external device and a second y-axis-polarized wave guide 260*a* which supplies the y-axis-polarized waves to the cross-shaped coupling apertures 255, 245, and 235.

The first y-axis-polarized wave guide 240*a* may be formed by a third plate 230, a fourth plate 240, and a fifth plate 250. The third plate 230, as shown in FIG. 8 may include the plurality of first cross-shaped coupling slots 235 that may be uniformly formed. The plurality of first cross-shaped coupling slots 235 may be a part of the cross-shaped coupling apertures 255, 245, and 235 which supply the x-axis-polarized waves and y-axis-polarized waves from the supply unit 202 to the emission unit 201. The x-axis-polarized waves and y-axis-polarized waves may be supplied to the emission unit 201 through the first cross-shaped coupling slots 235 of the third plate 230.

Figure 9:
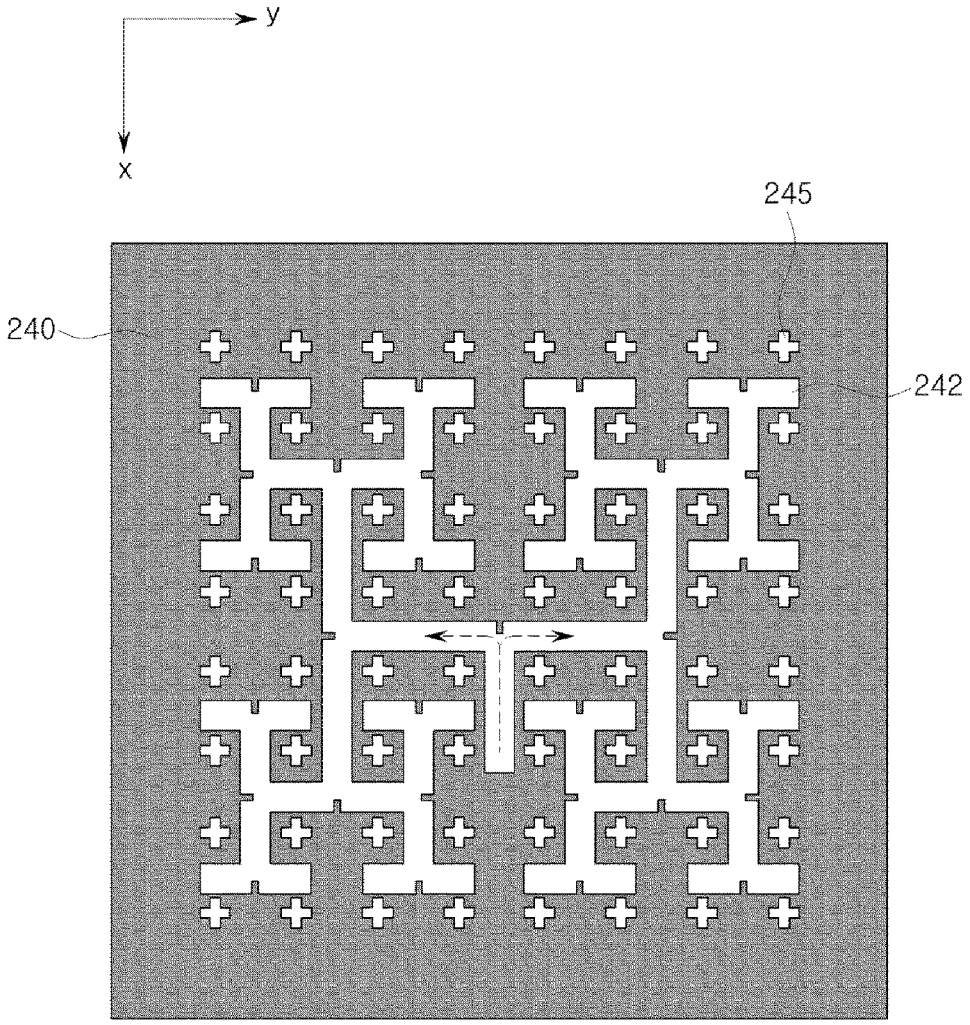

The fourth plate 240, as shown in FIG. 9, may include the first y-axis-polarized wave guide-forming slots 242 which form the first-y-axis-polarized wave guide 240*a* and second cross-shaped coupling slots 245 which form the cross-shaped coupling apertures 255, 245, and 235 which supply the x-axis-polarized waves and y-axis-polarized waves to the emission cavity 220*a*. The second cross-shaped coupling slots 245 may be formed to correspond to the first cross-shaped coupling slots 235. The first y-axis-polarized wave guide-forming slots 242 may be formed among a plurality of such second cross-shaped coupling slots 245. For example, widths of the first y-axis-polarized wave guide-forming slots 242 may be about the same to half wave ($\lambda/2$) of the y-axis-polarized waves. In other words, a width of the first y-axis-polarized wave guide 240*a* may be about the same to half wave ($\lambda/2$) of the y-axis-polarized waves and may be based on frequencies and wavelengths of the y-axis-polarized waves.

Figure 10:
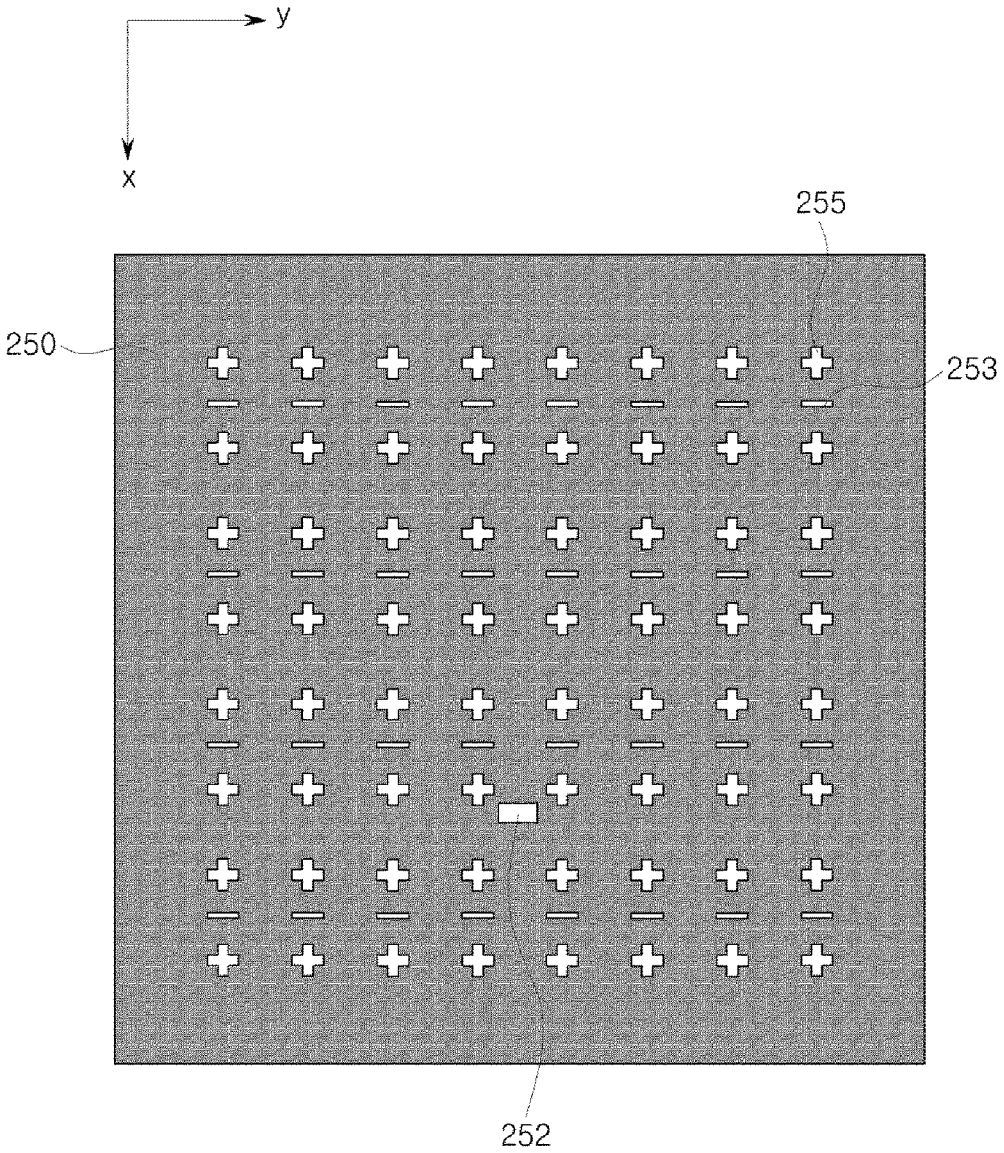

The fifth plate 250, as shown in FIG. 10, may include a fifth y-axis-polarized wave supply slot 252 which forms the y-axis-polarized wave supply apertures 292, 282, 272, 262, and 252 which supply the y-axis-polarized waves to the y-axis-polarized wave guides 240*a* and 260*a*. The y-axis-polarized wave coupling slots 253 which supply the y-axis-polarized waves of the first y-axis-polarized wave guide 240*a* to the second y-axis-polarized wave guide 260*a*, and third cross-shaped coupling slots 255 which form the cross-shaped coupling apertures 255, 245, and 235 which supply the x-axis-polarized waves and y-axis-polarized waves to the emission cavity 220*a*. The third cross-shaped coupling slots 255 may be formed to correspond to the first cross-shaped coupling slots 235 and the cross-shaped coupling slots 245. Additionally, the y-axis-polarized wave coupling slots 253 may be formed to correspond to the first y-axis-polarized wave guide-forming slots 242. The first y-axis-polarized wave guide 240*a* guides the y-axis-polarized waves supplied through the y-axis-polarized wave supply apertures 292, 282, 272, 262, and 252 to the y-axis-polarized wave coupling slots 253. The y-axis-polarized waves may be supplied to the second y-axis-polarized wave guide 260*a* through the y-axis-polarized wave coupling slots 253.

Referring to FIGS. 8, 9, and 10, the first y-axis-polarized wave guide 240*a* may uniformly extend from a center of the antenna 200 to every portions of the antenna 200. Additionally, the y-axis-polarized wave supply apertures 292, 282, 272, 262, and 252 may be formed in a center of the first y-axis-polarized wave guide 240*a* and the y-axis-polarized wave coupling slots 253 may be formed at an end of the first y-axis-polarized wave guide 240*a*. Accordingly, the y-axis-polarized waves may be transmitted from the y-axis-polarized wave supply apertures 292, 282, 272, 262, and 252 to the plurality of y-axis-polarized wave coupling slots 253 along the first y-axis-polarized wave guide 240*a*. Additionally, lengths of paths which extend from the y-axis-polarized wave supply apertures 292, 282, 272, 262, and 252 to the plurality of y-axis-polarized wave coupling slots 253 along the first y-axis-polarized wave guide 240*a* may be about the same. In other words, distances in which the y-axis-polarized waves are transmitted from the y-axis-polarized wave supply apertures 292, 282, 272, 262, and 252 to the plurality of y-axis-polarized wave coupling slots 253 along the first y-axis-polarized wave guide 240*a* may be about the same. As a result, the y-axis-polarized waves supplied to the second y-axis-polarized wave guide 260*a* through the plurality of y-axis-polarized wave coupling slots 253 may include about the same phases and amplitudes.

The second y-axis-polarized wave guide 260*a* may be formed by the fifth plate 250, a sixth plate 260, and the seventh plate 270. The fifth plate 250, as shown in FIG. 10, may include the fifth y-axis-polarized wave supply slot 252, the y-axis-polarized wave coupling slots 253, and the third cross-shaped coupling slots 255. The third cross-shaped coupling slots 255 may be formed to correspond to the first cross-shaped coupling slots 235 and the second cross-shaped coupling slots 245. The y-axis-polarized wave coupling slots 253 may be formed to correspond to the first y-axis-polarized wave guide-forming slots 242.

Figure 11:
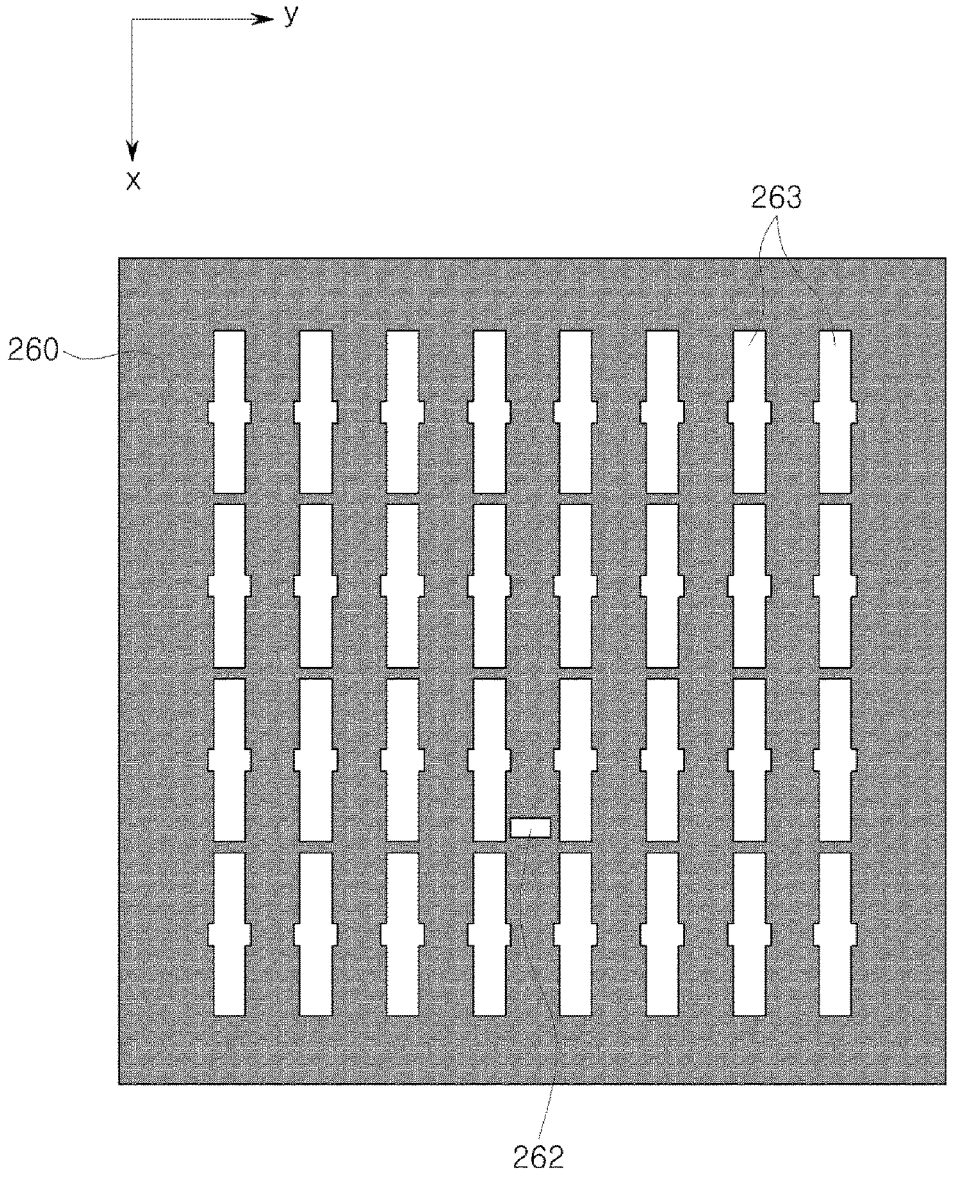

The sixth plate 260, as shown in FIG. 11, may include second y-axis-polarized wave guide-forming slots 263 to form the second y-axis-polarized wave guide 260*a* and a fourth y-axis-polarized wave supply slot 262 which forms the y-axis-polarized wave supply apertures 292, 282, 272, 262, and 252 which supply the y-axis-polarized waves to the y-axis-polarized wave guides 240*a* and 260*a*. The second y-axis-polarized wave guide-forming slots 263 may be formed in positions to correspond to the y-axis-polarized wave coupling slots 253 and the third cross-shaped coupling slots 255 of the fifth plate 250. For example, widths of the second y-axis-polarized wave guide-forming slots 263 may be about the same to half wave ($\lambda/2$) of the y-axis-polarized waves. In other words, a width of the second y-axis-polarized wave guide 260*a* may be about the same to half wave ($\lambda/2$) of the y-axis-polarized waves and may be based on frequencies and wavelengths of the y-axis-polarized waves.

The seventh plate 270, as shown in FIG. 12, may include the x-axis-polarized wave coupling slots 271 which supply the x-axis-polarized waves of the x-axis-polarized wave guide 280*a* to the cross-shaped coupling apertures 255, 245, and 235 and the third y-axis-polarized wave supply slot 272 which forms the y-axis-polarized wave supply apertures 292, 282, 272, 262, and 252 which supply the y-axis-polarized waves to the y-axis-polarized wave guides 240*a* and 260*a*.

The second y-axis-polarized wave guide 260*a* guides the y-axis-polarized waves supplied through the y-axis-polarized wave coupling slots 253 to the cross-shaped coupling apertures 255, 245, and 235. The y-axis-polarized waves guided to the cross-shaped coupling apertures 255, 245, and 235 may be supplied to the emission cavity 220*a* through the cross-shaped coupling apertures 255, 245, and 235. Referring to FIGS. 10, 11, and 12, the second y-axis-polarized wave guide 260*a* may connect the y-axis-polarized wave coupling slots 253, the x-axis-polarized wave coupling slots 271, and the cross-shaped coupling apertures 255, 245, and 235.

The x-axis-polarized waves supplied from the x-axis-polarized wave coupling slots 271 may be transmitted through the second y-axis-polarized wave guide 260*a* and may be supplied to the cross-shaped coupling apertures 255, 245, and 235. Additionally, the y-axis-polarized waves supplied from the y-axis-polarized wave coupling slots 253 may move along the second y-axis-polarized wave guide 260*a* and may be supplied to the cross-shaped coupling apertures 255, 245, and 235. For example, since the x-axis-polarized waves and the y-axis-polarized waves are vertical to each other, an interference phenomenon between the x-axis-polarized waves and the y-axis-polarized waves may be minimized. The x-axis-polarized waves move along the x-axis-polarized wave guide 280*a* and may be supplied to the cross-shaped coupling apertures 255, 245, and 235, and the y-axis-polarized waves may move along the first y-axis-polarized wave guide 240*a* and the second y-axis-polarized wave guide 260*a* and may be supplied to the cross-shaped coupling apertures 255, 245, and 235. Hereinafter, a movement of electromagnetic waves (e.g., x-axis-polarized waves and y-axis-polarized waves) inside the antenna 200 will be described. Hereinafter, to assist in the understanding the movement of the electromagnetic waves, a conductor such as metal which forms an exterior of the antenna 200 will be omitted and only a wave guide formed by the conductor will be shown in FIGS. 15 to 23. In other words, in FIGS. 15 to 23, an exterior of the wave guide is formed of the conductor but is merely omitted. FIG. 15 illustrates a part of a wave guide formed in the antenna 200 in accordance with one exemplary embodiment of the present invention. In particular, in FIG. 15, only the wave guide in which electromagnetic waves which include x-axis-polarized waves and y-axis-polarized waves move is shown but the conductor which forms the wave guide is omitted.

Referring to FIG. 15, the wave guide of the antenna 200 may include the emission unit 201 configured to emit the x-axis-polarized waves and y-axis-polarized waves and the supply unit 202 configured to supply the x-axis-polarized waves and y-axis-polarized waves to the emission unit 201. As described above, the emission unit 201 may include the emission cavity 220*a* and the cross-shaped emission slots 215*a*, 215*b*, 215*c*, and 215*d* and the supply unit 202 may include the x-axis-polarized wave guide 280*a*, the y-axis-polarized wave guides 240*a* and 260*a*, and the cross-shaped coupling apertures 255, 245, and 235.

Figure 16:
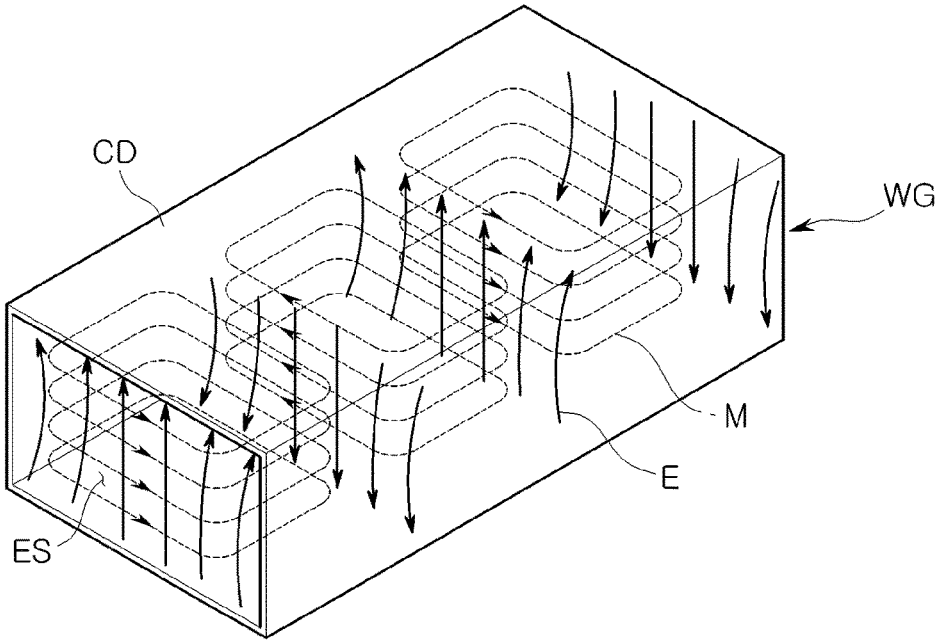
FIG. 16 illustrates an exemplary magnetic field and an electric field of the wave guide formed in the antenna in accordance with an exemplary embodiment of the present invention.

First, transmission and resonance of electromagnetic waves in a wave guide will be described. FIG. 16 illustrates a magnetic field and an electric field of a wave guide WG formed in the antenna 200. As shown in FIG. 16, the wave guide WG may include an empty space ES in which electromagnetic waves may be transmitted or resonate and a guide CD that surrounds the empty space ES. The empty space ES may be filled with a dielectric or air. Additionally, the guide CD may be formed of a conductor through which electricity flows and may be biased with a particular voltage. For example, the guide CD may be grounded. When electromagnetic waves E and M are emitted to the wave guide WG, the emitted electromagnetic waves E and M may be transmitted along the empty space ES of the wave guide WG. In other words, the wave guide WG guides the emitted electromagnetic waves in a particular direction. The electromagnetic waves E and M of the wave guide WG may be transmitted while forming electric fields E and magnetic fields M in various shapes based on a mode.

For example, in a transverse electric (TE) mode, the electromagnetic waves E and M may be transmitted while forming the electric fields E and the magnetic fields M as shown in FIG. 16. In particular, the electric fields E may be transmitted while oscillating in a direction vertical to a transmission direction and the magnetic fields M may be transmitted while rotating inside the wave guide WG. For example, a distance between centers of the magnetic fields M that rotates in the same direction becomes a wavelength $\lambda$ of the electromagnetic waves E and M. Additionally, when the electromagnetic waves E and M are transmitted, centers of the magnetic fields M which rotate may move in the transmission direction. The electromagnetic waves E and M may be transmitted and may also may resonate in the wave guide WG.

When a length of the wave guide WG corresponds to integer times of about half wave $\lambda/2$ of the electromagnetic waves E and M and an end of the wave guide WG may be cut off by a conductor. For example, the electromagnetic waves E and M may not be transmitted and resonate inside the wave guide WG. When the electromagnetic waves E and M resonate inside the wave guide WG, the electric fields E and the magnetic fields M may not move and the electric fields E may resonate at particular positions and the magnetic fields M may rotate in particular positions.

The antenna 200 may be configured to emit the electromagnetic waves E and M into a free air space using such a resonance phenomenon of the electromagnetic waves E and M. For example, when a slot is formed in the wave guide WG, a portion of the electromagnetic waves E and M which resonate in the wave guide WG may be emitted into the free air space through the slot. The emitted electromagnetic waves may have about the same frequencies as those of the electromagnetic waves E and M which resonate in the wave guide WG. As described above, the wave guide WG may be configured to emit the electromagnetic waves E and M therein outward through the slot. The emitted electromagnetic waves may have the same properties as those of the electromagnetic waves E and M of the wave guide WG. In other words, the wave guide WG itself may become an antenna. Hereinafter, for understanding, it may be assumed that the electromagnetic waves of the wave guide WG formed in the antenna 200 are in the TE mode. However, the electromagnetic waves of the antenna 200 are not limited to the TE mode but may be in a transverse electromagnetic (TEM) mode or a transverse magnetic (TM) mode.

Figure 17:
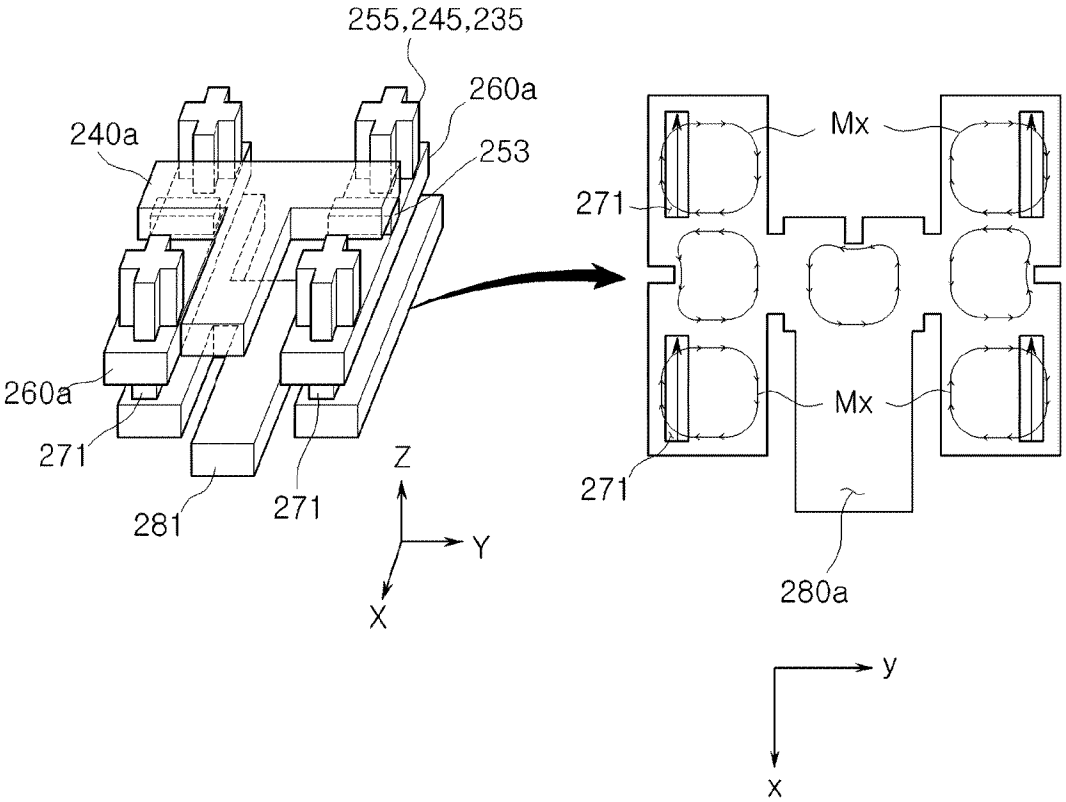
FIG. 17 illustrates exemplary x-axis-polarized waves of an x-axis-polarized wave guide formed in the antenna in accordance with an exemplary embodiment of the present invention.

FIG. 17 illustrates the x-axis-polarized waves of the x-axis-polarized wave guide 280*a* formed in the antenna 200. In particular, a wave guide formed in the antenna 200 is shown in a left side of FIG. 17 and the x-axis-polarized waves of the x-axis-polarized wave guide 280*a* are shown in a right side of FIG. 17. As shown in the left side of FIG. 17, the x-axis-polarized wave guide 280*a* may be formed on a lowermost layer and may be configured to supply the externally supplied x-axis-polarized waves to the cross-shaped coupling apertures 255, 245, and 235 on top. As shown in the right side of FIG. 17, the width of the x-axis-polarized wave guide 280*a* may be about the same to about half wave $\lambda/2$ and x-axis-polarized wave magnetic fields Mx and x-axis-polarized wave electric fields (not shown) may be formed in the x-axis-polarized wave guide 280*a*. Hereinafter, for understanding, magnetic fields in a wave guide will be described. Although not described in detail, electric fields are formed in a direction vertical to the magnetic fields in the wave guide.

The x-axis-polarized waves in the x-axis-polarized wave guide 280*a* may be supplied from the x-axis-polarized wave supply slot 291 formed in the center of the x-axis-polarized wave guide 280*a*. Additionally, the x-axis-polarized waves may be supplied to the cross-shaped coupling apertures 255, 245, and 235 through the x-axis-polarized wave coupling slots 271 formed at the end of the x-axis-polarized wave guide 280*a*. For example, the x-axis-polarized waves in the x-axis-polarized wave guide 280*a* may be configured supply energy of the x-axis-polarized waves to the cross-shaped coupling apertures 255, 245, and 235 while not moving but resonating. In addition, the x-axis-polarized wave magnetic fields Mx in the x-axis-polarized wave guide 280*a* may rotate in fixed positions but do not move as shown in the right side of FIG. 17.

Furthermore, the x-axis-polarized wave magnetic fields Mx which rotate clockwise may be formed at all ends of the x-axis-polarized wave guide 280*a*. In particular, a rotation direction of the x-axis-polarized wave magnetic fields Mx formed at the ends of the x-axis-polarized wave guide 280*a* may not be limited to a clockwise rotation. The x-axis-polarized wave magnetic fields Mx which rotate counterclockwise may be formed. However, to prevent an offset of the x-axis-polarized waves emitted from the antenna 200, the rotation directions of the x-axis-polarized wave magnetic fields Mx formed at the ends of the x-axis-polarized wave guide 280*a* may be about the same. For example, to form the x-axis-polarized wave magnetic fields Mx which rotate in the same direction at all the ends of the x-axis-polarized wave guide 280*a*, the width and length of the x-axis-polarized wave guide 280*a* may be set. Above the ends of the x-axis-polarized wave guide 280*a*, the x-axis-polarized wave coupling slots 271 which supply the x-axis-polarized waves to the cross-shaped coupling apertures 255, 245, and 235 may be formed. In other words, the x-axis-polarized wave coupling slots 271 may be formed in x-axis directions based on coordinate systems shown in the drawing. For example, the x-axis-polarized wave coupling slots 271 may be formed in a direction about the same to the transmission direction of the energy of the x-axis-polarized waves. Additionally, the x-axis-polarized wave coupling slots 271 may be formed on an edge of the end of the x-axis-polarized wave guide 280*a*, since, strengths of magnetic fields in a wave guide are highest on the edge of the wave guide. For example, the magnetic fields in the x-axis direction may be formed on the edge of the end of the x-axis-polarized wave guide 280*a*. As described above, the x-axis-polarized wave coupling slots 271 in the x-axis direction may be formed on the edge of the end of the x-axis-polarized wave guide 280*a*, and may thereby supply polarized waves in the x-axis direction, that is, the x-axis-polarized waves from the x-axis-polarized wave guide 280*a* to the cross-shaped coupling apertures 255, 245, and 235.

Figure 18:
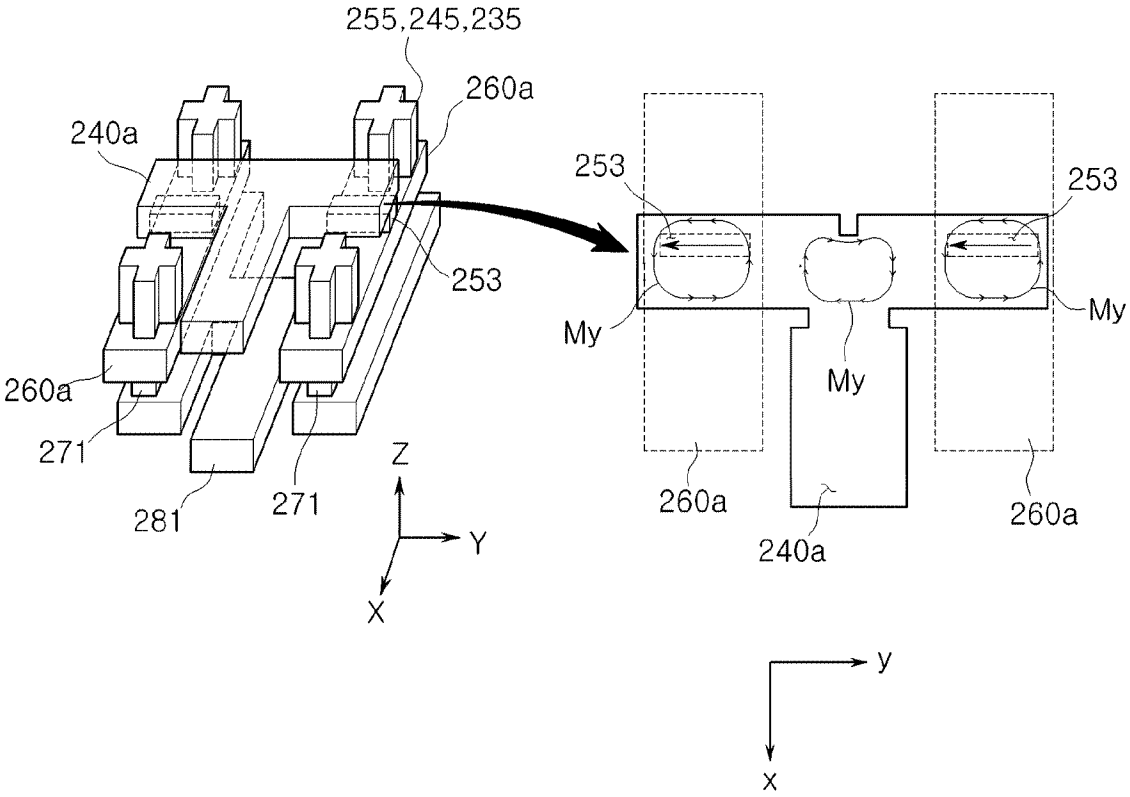
FIG. 18 illustrates an exemplary y-axis-polarized waves of a first y-axis-polarized wave guide formed in the antenna in accordance with an exemplary embodiment of the present invention.
Figure 19:
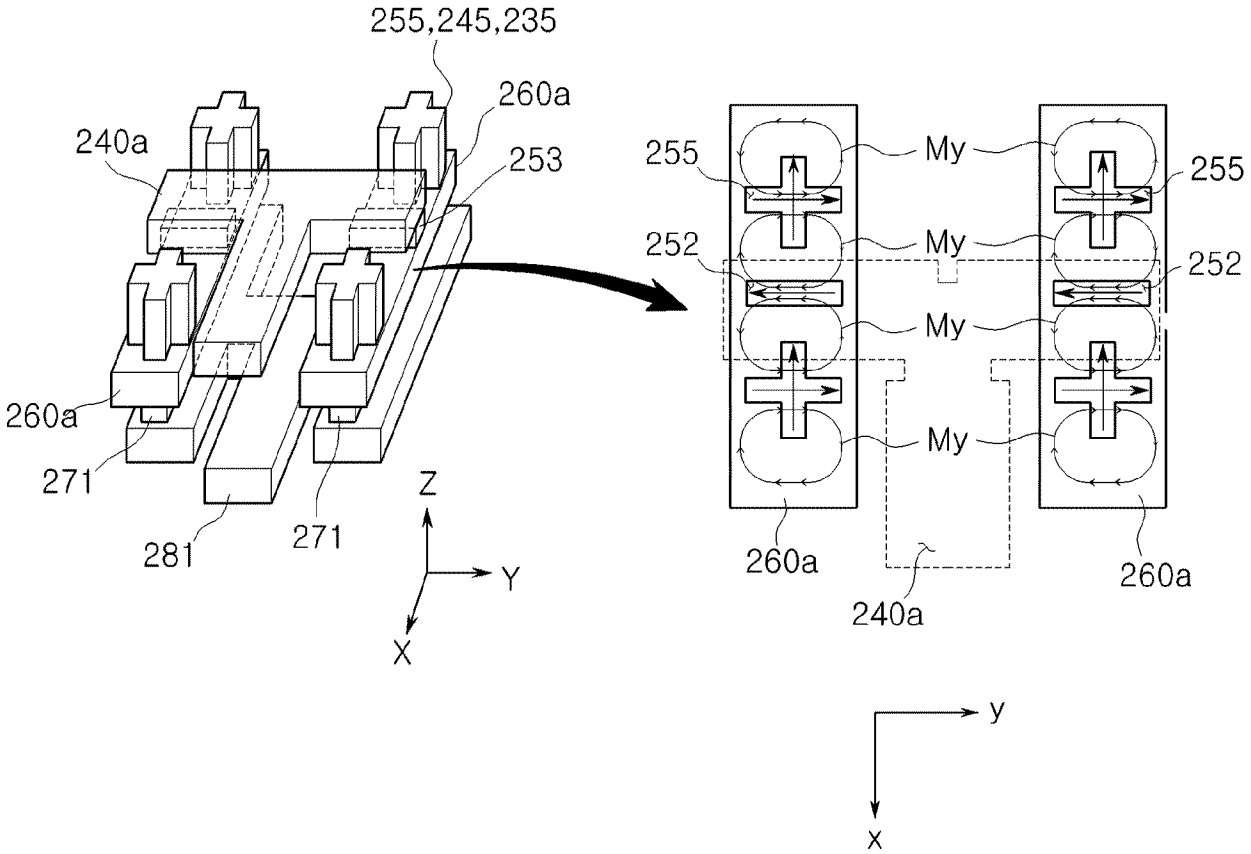
FIG. 19 illustrates exemplary y-axis-polarized waves of a second y-axis-polarized wave guide formed in the antenna in accordance with an exemplary embodiment of the present invention.

FIG. 18 illustrates the y-axis-polarized waves of the first y-axis-polarized wave guide 240*a* formed in the antenna 200. FIG. 19 illustrates the y-axis-polarized waves of the second y-axis-polarized wave guide 260*a* formed in the antenna 200. In particular, wave guides formed in the antenna 200 are shown in left sides of FIGS. 18 and 19, the y-axis-polarized waves of the first y-axis-polarized wave guide 240*a* are shown in a right side of FIG. 18, and the y-axis-polarized waves of the second y-axis-polarized wave guide 260*a* are shown in a right side of FIG. 19. As described above, the y-axis-polarized wave guides 240*a* and 260*a* may include the first y-axis-polarized wave guide 240*a* and the second y-axis-polarized wave guide 260*a*. For example, the y-axis-polarized waves having the same phases and strengths may be supplied to the cross-shaped coupling apertures 255, 245, and 235.

In FIGS. 18 and 19, the first y-axis-polarized wave guide 240*a* may be disposed above the second y-axis-polarized wave guide 260*a* but is not limited thereto. The first y-axis-polarized wave guide 240*a* may be disposed below the second y-axis-polarized wave guide 260*a*. As shown in the right side of FIG. 18, the width of the first y-axis-polarized wave guide 240*a* may be about the same to about half wave $\lambda/2$ of the y-axis-polarized waves and y-axis-polarized wave magnetic fields My and y-axis-polarized wave electric fields (not shown) are formed therein. Hereinafter, for understanding, magnetic fields in a wave guide will be described. Although not described in detail, electric fields may be formed in a direction vertical to the magnetic fields in the wave guide.

The y-axis-polarized waves in the first y-axis-polarized wave guide 240*a* may be supplied from the y-axis-polarized wave supply apertures 292, 282, 272, 262, and 252 formed in the center of the first y-axis-polarized wave guide 240*a*. Additionally, the y-axis-polarized waves may be supplied to the second y-axis-polarized wave guide 260*a* through the y-axis-polarized wave coupling slots 253 formed at the end of the first y-axis-polarized wave guide 240*a*. In other words, the y-axis-polarized waves in the first y-axis-polarized wave guide 240*a* may be configured to supply the energy of y-axis-polarized waves to the second y-axis-polarized wave guide 260*a* while not moving but resonating. In particular, the y-axis-polarized wave magnetic fields My in the first y-axis-polarized wave guide 240*a* may rotate in fixed positions but do not move as shown in the right side of FIG. 18. Further, the y-axis-polarized wave magnetic fields My which rotate counterclockwise may be formed at the ends of the first y-axis-polarized wave guide 240*a*.

For example, a rotation direction of the y-axis-polarized wave magnetic fields My formed at the ends of the first y-axis-polarized wave guide 240*a* may not be limited to a counterclockwise rotation. The y-axis-polarized wave magnetic fields My which rotate clockwise may be formed. However, to prevent a mutual offset of the y-axis-polarized waves emitted from the antenna 200, the rotation directions of the y-axis-polarized wave magnetic fields My formed at the ends of the first y-axis-polarized wave guide 240*a* may be about the same. In particular, to form the y-axis-polarized wave magnetic fields My which may rotate in the same direction at the ends of the first y-axis-polarized wave guide 240*a*, the width and length of the first y-axis-polarized wave guide 240*a* may be fixed.

The y-axis-polarized wave coupling slots 253 which supply the y-axis-polarized waves to the second y-axis-polarized wave guide 260*a* may be formed below the end of the first y-axis-polarized wave guide 240*a*. For example, the y-axis-polarized wave coupling slots 253 may be formed in y-axis directions based on coordinate systems shown in the drawings. In other words, the y-axis-polarized wave coupling slots 253 may be formed in a direction that may be about the same to the transmission direction of the energy of the y-axis-polarized waves. Additionally, the y-axis-polarized wave coupling slots 253 may be formed on an edge of the end of the first y-axis-polarized wave guide 240*a*. For example, the strengths of magnetic fields in a wave guide are highest on the edge of the wave guide since the magnetic fields in the y-axis direction may be formed on the edge of the end of the first y-axis-polarized wave guide 240*a*.

As described above, the y-axis-polarized wave coupling slots 253 in the y-axis direction may be formed on the edge of the end of the first y-axis-polarized wave guide 240*a*, thereby to supply polarized waves in the y-axis direction, that is, the y-axis-polarized waves from the first y-axis-polarized wave guide 240*a* to the second y-axis-polarized wave guide 260*a*. As shown in the right side of FIG. 19, the width of the second y-axis-polarized wave guide 260*a* may be about the same to half wave λ/2 of the y-axis-polarized waves and the y-axis-polarized wave magnetic fields My and y-axis-polarized wave electric fields (not shown) may be formed therein. Hereinafter, for understanding, magnetic fields in a wave guide will be described.

The y-axis-polarized waves in the second y-axis-polarized wave guide 260*a* may be supplied from the y-axis-polarized wave coupling slots 253 formed in the respective centers of the second y-axis-polarized wave guides 260*a*. In particular, the y-axis-polarized waves may be induced in the second y-axis-polarized wave guides 260*a* by the y-axis-polarized waves supplied from the first y-axis-polarized wave guide 240*a* through the y-axis-polarized wave coupling slots 253. The induced y-axis-polarized waves may extend to both ends of the second y-axis-polarized wave guides 260*a*. Additionally, the y-axis-polarized waves in the second y-axis-polarized wave guides 260*a* may be supplied to the cross-shaped coupling apertures 255, 245, and 235 may be formed in the both ends of the second y-axis-polarized wave guides 260*a*. For example, the cross-shaped coupling apertures 255, 245, and 235 may be formed on the both ends of the second y-axis-polarized wave guides 260*a* may be formed at the same distance from the y-axis-polarized wave coupling slots 253, and may be configured to supply the y-axis-polarized waves having about the same strength and phase to the cross-shaped coupling apertures 255, 245, and 235.

For example, the y-axis-polarized waves in the second y-axis-polarized wave guide 260*a* supply energy of the y-axis-polarized waves to the cross-shaped coupling apertures 255, 245, and 235 while not moving but resonating. In particular, the y-axis-polarized wave magnetic fields My in the second y-axis-polarized wave guide 260*a* rotate in fixed positions but do not move as shown in the right side of FIG. 19. Additionally, the y-axis-polarized wave magnetic fields My which rotate counterclockwise may be formed at one end of the second y-axis-polarized wave guide 260*a* and the y-axis-polarized wave magnetic fields My which rotate clockwise may be formed at the other end of the second y-axis-polarized wave guide 260*a*. As described above, due to a difference between the rotation directions of the y-axis-polarized wave magnetic fields My which are formed at the both ends of the second y-axis-polarized wave guide 260*a*, the y-axis-polarized waves in the same direction may be supplied to the cross-shaped coupling apertures 255, 245, and 235.

The x-axis-polarized wave coupling slots 271, through which x-axis-polarized waves are transmitted, may be formed below the both ends of the second y-axis-polarized wave guide 260*a*. Centers of the x-axis-polarized wave coupling slots 271 may be disposed spaced apart from the both ends of the second y-axis-polarized wave guide 260*a* at about half wave λ/2 of the y-axis-polarized waves. Additionally, the cross-shaped coupling apertures 255, 245, and 235 which supply the x-axis-polarized waves and the y-axis-polarized waves to the emission unit 201 may be formed above the end of the second y-axis-polarized wave guide 260*a*. Centers of the cross-shaped coupling apertures 255, 245, and 235 may also be spaced apart from the both ends of the second y-axis-polarized wave guide 260*a* at about half wave λ/2 of the y-axis-polarized waves. As a result, the x-axis-polarized waves may be supplied through the x-axis-polarized wave coupling slots 271 and the y-axis-polarized waves may be supplied through the y-axis-polarized wave coupling slots 253 may be mixed in the second y-axis-polarized wave guide 260*a*.

However, the x-axis-polarized waves may not resonate in the second y-axis-polarized wave guide 260*a* and may be supplied to the cross-shaped coupling apertures 255, 245, and 235. Further, the y-axis-polarized waves may not be transmitted to the x-axis-polarized wave guide 280*a* through the x-axis-polarized wave coupling slots 271 and may be supplied to the cross-shaped coupling apertures 255, 245, and 235. In other words, the x-axis-polarized waves and the y-axis-polarized waves do not mutually interfere due to the positions of the x-axis-polarized wave coupling slots 271 and the cross-shaped coupling apertures 255, 245, and 235.

Figure 20:
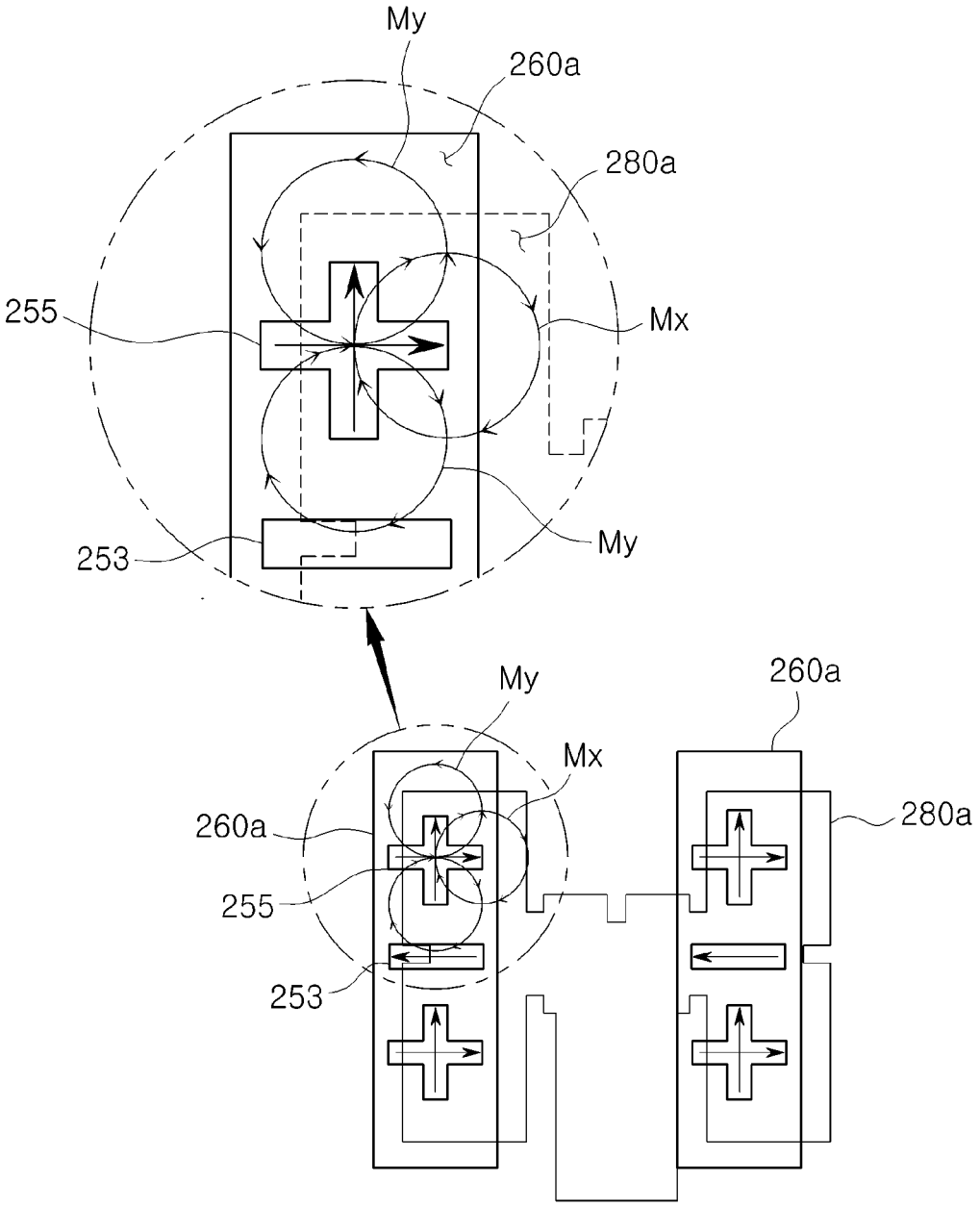
FIG. 20 illustrates an exemplary x-axis-polarized waves of the x-axis-polarized wave guide and the y-axis-polarized waves of the second y-axis-polarized wave guide formed in the antenna in accordance with an exemplary embodiment of the present invention.

FIG. 20 illustrates the x-axis-polarized waves of the x-axis-polarized wave guide 280*a* and the y-axis-polarized waves of the second y-axis-polarized wave guide 260*a* may be formed in the antenna 200. Referring to FIG. 20, a relationship between the x-axis-polarized waves and the y-axis-polarized waves may be described. As shown in a left side of FIG. 20, both ends of the second y-axis-polarized wave guide 260*a* may protrude about ¼ of wavelengths (λ/4) of the x-axis-polarized waves and the y-axis-polarized waves than those of the x-axis-polarized wave guide 280*a*. In other words, the second y-axis-polarized wave guide 260*a* may be longer about ½ of wavelengths (λ/2) of the x-axis-polarized waves and the y-axis-polarized waves than the x-axis-polarized wave guide 280*a*. Additionally, the width of the second y-axis-polarized wave guide 260*a* and the width of the x-axis-polarized wave guide 280*a* may be about half wave λ/2 of the x-axis-polarized waves and the y-axis-polarized waves may be about the same. However, the second y-axis-polarized wave guide 260*a* may deviate about ¼ of wavelengths (λ/4) of the x-axis-polarized waves and the y-axis-polarized waves from the x-axis-polarized wave guide 280*a*.

Additionally, as shown in the left side of FIG. 20, the x-axis-polarized wave coupling slots 271 may be formed in the x-axis direction in the center of the end of the second y-axis-polarized wave guide 260*a*. Further, the cross-shaped coupling apertures 255, 245, and 235 may be formed above the x-axis-polarized wave coupling slots 271. The x-axis-polarized waves may be supplied to the center of the end of the second y-axis-polarized wave guide 260*a* through the x-axis-polarized wave coupling slots 271. In particular, to allow the x-axis-polarized waves to resonate inside the second y-axis-polarized wave guide 260*a*, a space that allows the x-axis-polarized wave magnetic fields Mx to rotate, for example, a space of about half wave λ/2 at both ends or one side of the x-axis-polarized wave coupling slots 271 may be required. However, since the width of the second y-axis-polarized wave guide 260*a* may be about half wave λ/2 of the y-axis-polarized waves and the x-axis-polarized wave coupling slots 271 may be disposed in the center of the second y-axis-polarized wave guide 260*a*, a space that allows the x-axis-polarized waves to resonate is not provided.

Accordingly, the x-axis-polarized waves supplied to the second y-axis-polarized wave guide 260*a* may not resonate in the second y-axis-polarized wave guide 260*a* and may be supplied to the cross-shaped coupling apertures 255, 245, and 235 through the second y-axis-polarized wave guide 260*a*. Additionally, the y-axis-polarized waves may be supplied to the second y-axis-polarized wave guide 260*a* through the y-axis-polarized wave coupling slots 253 and resonate as shown in the right side of FIG. 19. As shown in the left side of FIG. 20, the y-axis-polarized waves rotate in the y-axis direction in the positions in which the x-axis-polarized wave coupling slots 253 may be formed. Accordingly, the y-axis-polarized waves in the second y-axis-polarized wave guide 260*a* may not be supplied to the x-axis-polarized wave guide 280*a* through the x-axis-polarized wave coupling slots 253 form in the x-axis direction but may be supplied to the cross-shaped coupling apertures 255, 245, and 235 through the third cross-shaped coupling slots 255 in which slots are formed in the x-axis direction and in the y-axis direction. As described above, the x-axis-polarized waves supplied through the x-axis-polarized wave guide 280*a* may not be transmitted to the y-axis-polarized wave guides 240*a* and 260*a* and the y-axis-polarized waves may not be supplied through the y-axis-polarized wave guides 240*a* and 260*a* may not supplied to the x-axis-polarized wave guide 280*a*.

Additionally, as shown in a right side of FIG. 20, in the second y-axis-polarized wave guide 260*a*, the x-axis-polarized waves may not be transmitted while oscillating in the x-axis direction and the y-axis-polarized waves may not be transmitted while oscillating in the y-axis direction. As described above, since the x-axis-polarized waves and the y-axis-polarized waves oscillate in mutually vertical directions, the x-axis-polarized waves and the y-axis-polarized waves do not mutually interfere.

The cross-shaped coupling apertures 255, 245, and 235 may supply the x-axis-polarized waves and the y-axis-polarized waves which intersect at right angles to the emission unit 201 which includes the emission cavity 220*a*. For example, the x-axis-polarized waves may be supplied through slots in the x-axis direction of the cross-shaped coupling apertures 255, 245, and 235 and the y-axis-polarized waves may be supplied through slots in the y-axis direction of the cross-shaped coupling apertures 255, 245, and 235. Additionally, the slots in the x-axis direction and the slots in the y-axis direction intersect each other, thereby forming the cross-shaped coupling apertures 255, 245, and 235.

Figure 21:
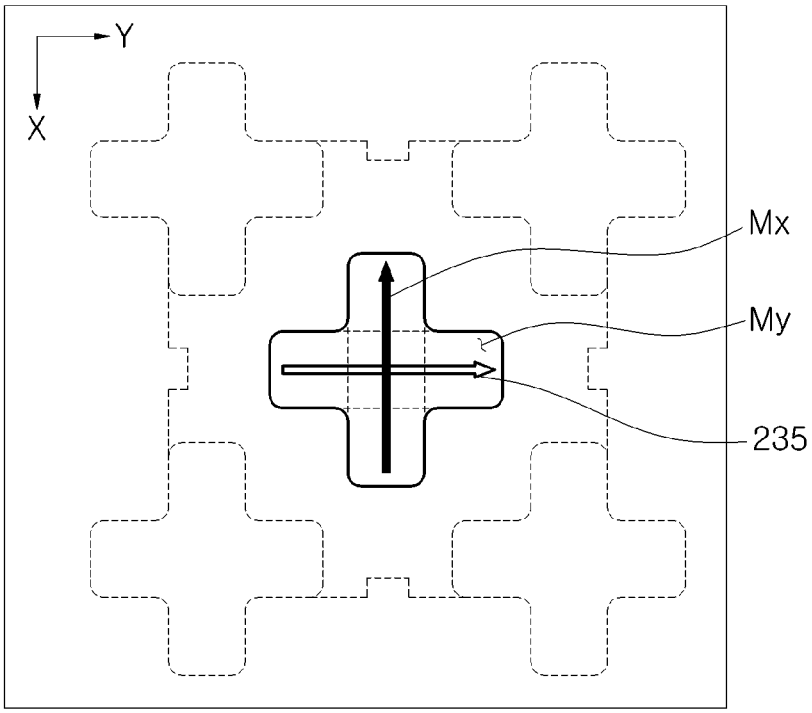
FIGS. 21 to 23 illustrate an exemplary x-axis-polarized waves and y-axis-polarized waves of the emission cavity formed in the antenna in accordance with an exemplary embodiment of the present invention.
Figure 22:
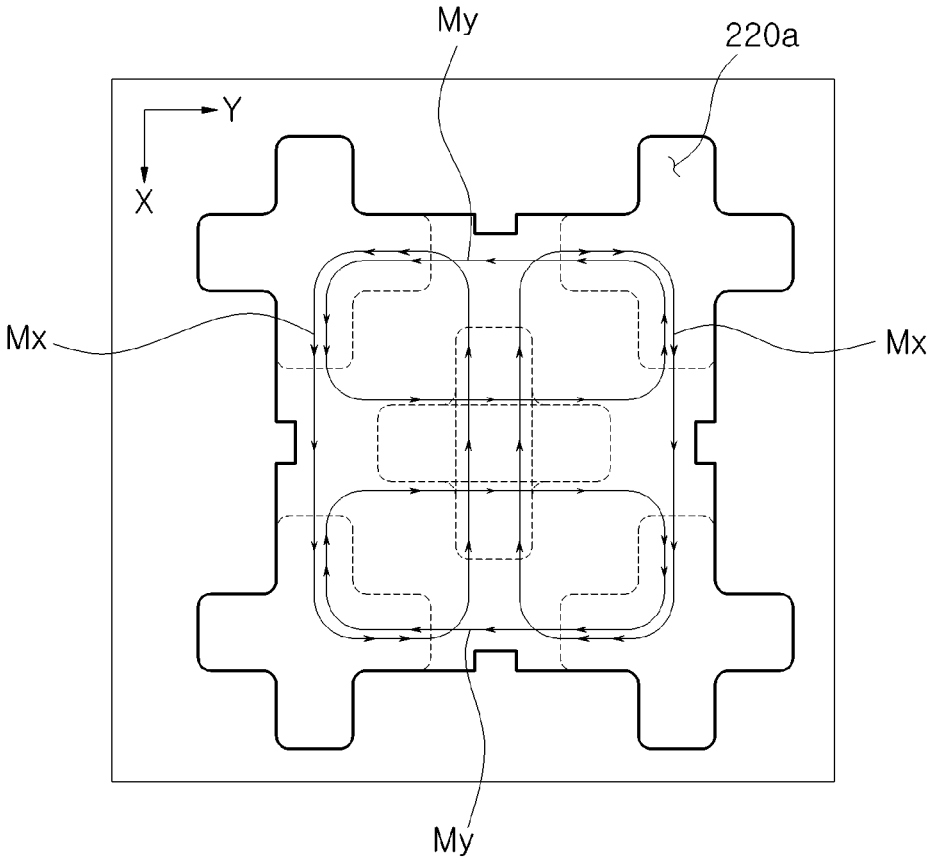
Figure 23:
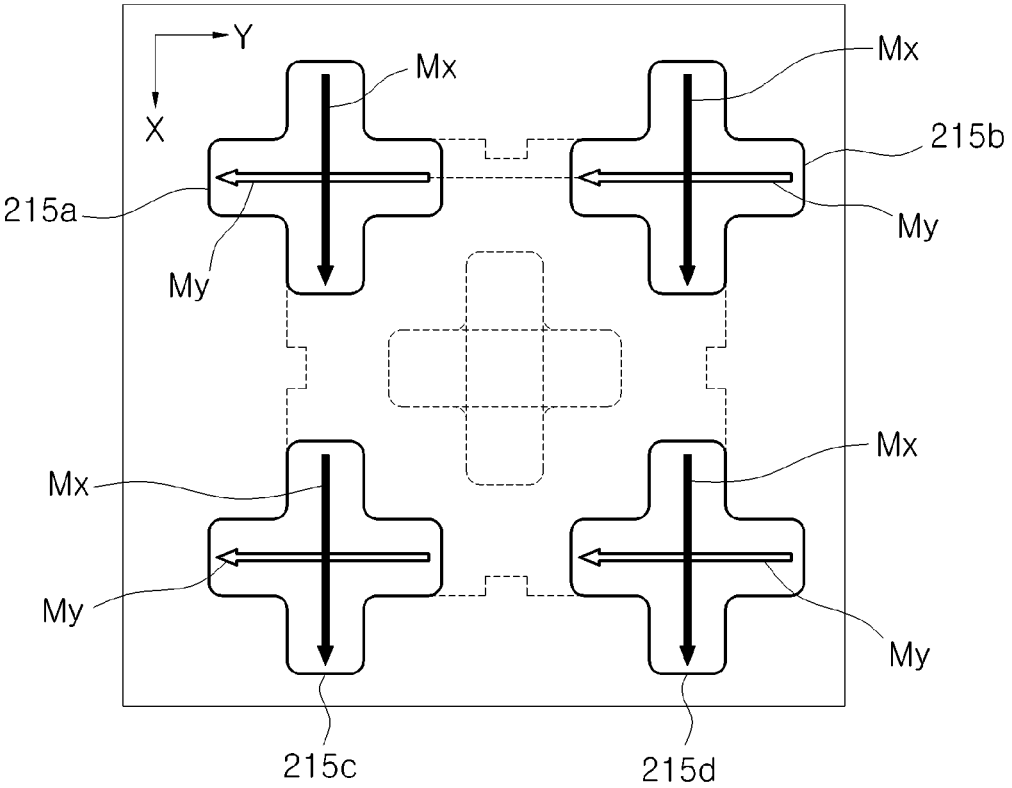

FIGS. 21 to 23 illustrate the x-axis-polarized waves and y-axis-polarized waves of the emission cavity 220*a* formed in the antenna 200. First, the x-axis-polarized waves and y-axis-polarized waves may be supplied to the emission cavity 220*a* through the cross-shaped coupling apertures 255, 245, and 235. In particular, the x-axis-polarized wave magnetic fields Mx and the y-axis-polarized wave magnetic fields My, as shown in FIG. 21, may be supplied to the emission cavity 220*a* while oscillating in mutually vertical directions. Additionally, the x-axis-polarized waves and y-axis-polarized waves may be induced in the emission cavity 220*a* by the x-axis-polarized waves and y-axis-polarized waves supplied through the cross-shaped coupling apertures 255, 245, and 235 and the induced x-axis-polarized waves and y-axis-polarized waves resonate in the emission cavity 220*a*. In particular, the x-axis-polarized wave magnetic fields Mx and the y-axis-polarized wave magnetic fields My which resonate as shown in FIG. 22 may be generated in the emission cavity 220*a* by the x-axis-polarized wave magnetic fields Mx and the y-axis-polarized wave magnetic fields My supplied through the cross-shaped coupling apertures 255, 245, and 235.

Furthermore, the x-axis-polarized waves and y-axis-polarized waves which resonate in the emission cavity 220*a* may be emitted into the free air space through the cross-shaped emission slots 215*a*, 215*b*, 215*c*, and 215*d*. In particular, the x-axis-polarized wave magnetic fields Mx and the y-axis-polarized wave magnetic fields My which resonate in the emission cavity 220*a*, as shown in FIG. 23, may be emitted into the free air space through the slots in the x-axis direction and the slots in the y-axis direction of the four cross-shaped emission slots 215*a*, 215*b*, 215*c*, and 215*d*, respectively. For example, the x-axis-polarized waves and y-axis-polarized waves which have the same phases and strengths may be emitted through the four cross-shaped emission slots 215*a*, 215*b*, 215*c*, and 215*d*. In other words, due to the emission cavity 220*a*, the x-axis-polarized waves and y-axis-polarized waves may not be distorted and emission density of each of the x-axis-polarized waves and y-axis-polarized waves may increase.

As described above, since the x-axis-polarized waves and y-axis-polarized waves supplied from one of the cross-shaped coupling apertures 255, 245, and 235 may be emitted through the four cross-shaped emission slots 215*a*, 215*b*, 215*c*, and 215*d*, the emission density which indicates a ratio of an area in which the electromagnetic waves, that is, the x-axis-polarized waves and y-axis-polarized waves may be emitted to a total area of the antenna 200 which may increase about four times. As a result, the directionalities of the x-axis-polarized waves and y-axis-polarized waves emitted by the antenna 200 may be improved.

Figure 24:
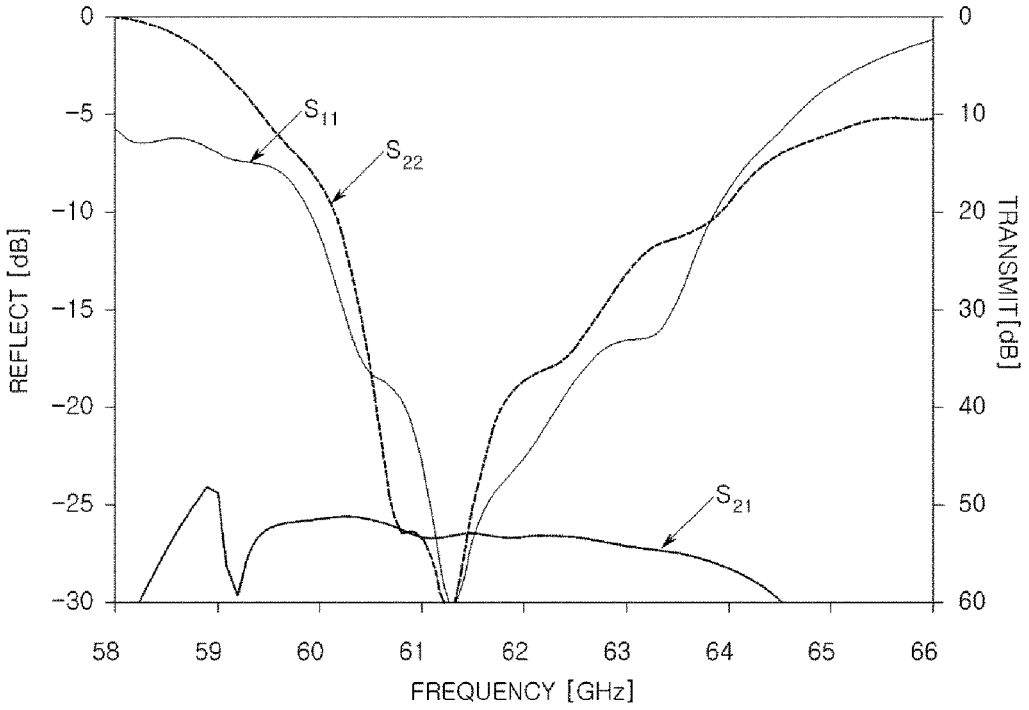
FIG. 24 illustrates an exemplary S-parameters of the antenna in accordance with an exemplary embodiment of the present invention.
Figure 25:
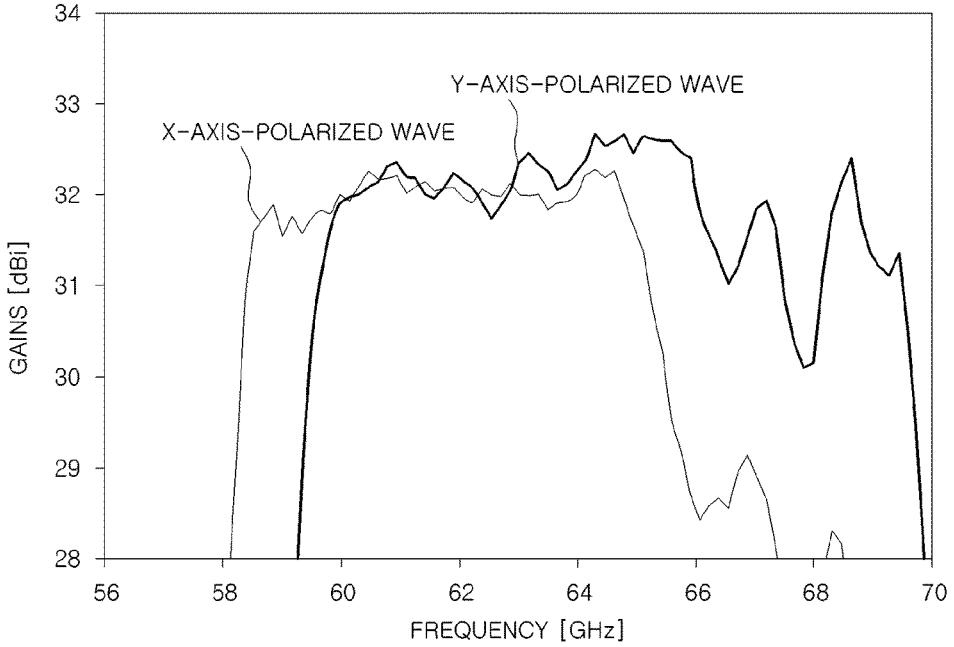
FIG. 25 illustrates an exemplary gain of the antenna in accordance with an exemplary embodiment of the present invention.

As described above, the structure and operations of the antenna 200 in accordance with an exemplary embodiment of the present invention have been described. Hereinafter, properties of the antenna 200 in accordance with an exemplary embodiment of the present invention will be described. FIG. 24 illustrates S-parameters of the antenna 200. FIG. 25 illustrates gains of the antenna 200. For example, FIGS. 24 and 25 illustrate experimental materials obtained based on an antenna with a center frequency of 60 GHz. Further, FIG. 24 indicates a reflectance of the antenna 200 with respect to the y-axis-polarized waves. In particular, S11 as shown in FIG. 24 may indicate a ratio of amplitudes of the y-axis-polarized waves output through the first y-axis-polarized wave supply slot 292 to amplitudes of the y-axis-polarized waves supplied through the first y-axis-polarized wave supply slot 292. Additionally, S22 in FIG. 24 indicates a reflectance of the antenna 200 with respect to the x-axis-polarized waves. Further, S22 indicates a ratio of amplitudes of the x-axis-polarized waves output through the x-axis-polarized wave supply slot 291 to amplitudes of the x-axis-polarized waves supplied through the x-axis-polarized wave supply slot 291. For example, a low reflectance in an antenna indicates that a substantial amount of power may be emitted into the free air space through the antenna.

According to an experiment, as shown in FIG. 24, based on −10 dB in which power of reflected electromagnetic waves is about 10%, a bandwidth of the x-axis-polarized waves and a bandwidth of the y-axis-polarized waves are about 4.2 GHz, respectively. In other words, the antenna 200 may have a broad bandwidth of about 7% based on the center frequency of 60 GHz. Additionally, S21 in FIG. 24 indicates interference between the x-axis-polarized waves and y-axis-polarized waves. In particular, S21 indicates a ratio of amplitudes of the y-axis-polarized waves output through the first y-axis-polarized wave supply slot 292 to amplitudes of the x-axis-polarized waves supplied through the x-axis-polarized wave supply slot 291. Minimal power transmitted from a y-axis-polarized wave supply circuit, the y-axis-polarized wave supply apertures and y-axis-polarized wave guides to an x-axis-polarized wave supply circuit, the x-axis-polarized wave supply slots and an x-axis-polarized wave guide indicates that the interference between the x-axis-polarized waves and the y-axis-polarized waves is minimized. According to the experiment, as shown in FIG. 24, an isolation degree is about 50 dB or more in an operation band based on −10 dB in which the power of the reflected electromagnetic waves may be about 10%. In other words, when the y-axis-polarized waves of 100,000 W are supplied through the y-axis-polarized wave supply circuit, the y-axis-polarized waves of about 1 W are output through the x-axis-polarized wave supply circuit.

The gains in FIG. 25 indicate gains of an antenna and differ from gains in a general circuit theory. The gains of the antenna are examples of relative gains generated due to the directionality of electromagnetic waves emitted by the antenna. In other words, the gains of the antenna mean a ratio of a distance of the antenna in which the electromagnetic waves arrive in a particular direction to an isotropic antenna. Accordingly, great gains of the antenna mean that the antenna is able to emit the electromagnetic waves further in the particular direction. In other words, the great gains of the antenna indicate that the antenna has improved directionality.

According to the experiment, the antenna 200 in accordance with an exemplary embodiment of the present invention may have gains of about 32 decibels isotropic (dBi) or more in the operation band based on −10 dB in which the power of the reflected electromagnetic waves is about 10%. The antenna 200 commonly uses emission slots which emit respective polarized waves, thereby emitting a plurality of polarized waves in the same area as an antenna which uses single polarized waves. Particularly, the antenna 200 may have improved gains of the respective polarized waves and isolation therebetween, thereby providing a data transmission rate about two times compared with a single polarized wave antenna.

Additionally, the antenna 200 in accordance with an exemplary embodiment of the present invention does not use a medium such as a dielectric and may be formed of only a conductor, thereby achieving antenna efficiency of 70% or more. Further, the antenna 200 in accordance with an exemplary embodiment may include wave guides which guide the respective polarized waves to emission slots as separate layers and mixes the polarized waves at a point at which the respective polarized waves interest each other, to minimize interference between the polarized waves. Moreover, the antenna 200 in accordance with an exemplary embodiment of the present invention may increase an antenna emission density and may improve antenna directionality using an emission cavity which includes a plurality of emission slots.

As is apparent from the above description, an antenna in accordance with an exemplary embodiment of the present invention may have minimal loss in a millimeter wave band by excluding a dielectric from the antenna. An antenna may have high directivity by forming a plurality of emission slots in the antenna. A dual-polarized antenna may use vertical-polarized waves and horizontal-polarized waves at the same time using cross-shaped slots. Additionally, a providable data transfer rate may be increased by simultaneously using vertical-polarized waves and horizontal-polarized waves. An antenna that minimizes interference in vertical-polarized waves and horizontal-polarized waves by discrepantly arranging a wave guide for vertical-polarized waves and a wave guide for horizontal-polarized waves may be provided.

Although a few exemplary embodiments of the present invention have been shown and described, it would be appreciated by those skilled in the art that changes may be made in these exemplary embodiments without departing from the principles and spirit of the invention, the scope of which is defined in the claims and their equivalents.

What is claimed is:

1. An antenna, comprising:

an emission unit configured to emit first and second polarized waves which intersect each other; and a supply unit configured to supply the first and second polarized waves to the emission unit, wherein the supply unit includes, a plurality of cross-shaped coupling apertures to supply the first and second polarized waves to the emission unit, where each of the plurality of cross-shaped coupling apertures is formed by allowing a first slot through which the first polarized waves are transmitted and a second slot through which the second polarized waves are transmitted to intersect each other;

a first polarized wave guide that directs the first polarized waves to the plurality of cross-shaped coupling apertures, where the first polarized wave guide includes first coupling slots, each of which is formed parallel to a propagation direction of the first polarized waves, and the first polarized wave guide supplies the first polarized waves to the plurality of cross-shaped coupling apertures through the first coupling slots; and a second polarized wave guide which that directs the second polarized waves to the plurality of cross-shaped coupling apertures, where the second polarized wave guide includes second coupling slots, each of which is formed perpendicular to a propagation direction of the second polarized waves, and the second polarized wave guide supplies the second polarized waves to the plurality of cross-shaped coupling apertures through the second coupling slots, and wherein distances from first polarized wave supply slots that supply the first polarized waves to the first polarized wave guide to the plurality of cross-shaped coupling apertures are about the same and distances from second polarized wave supply slots that supply the second polarized waves to the second polarized wave guide to the plurality of cross-shaped coupling apertures are about the same.

2. The antenna of claim 1, wherein the first polarized wave guide and the second polarized wave guide are formed on different layers.

3. The antenna of claim 1, wherein the second polarized wave guide includes, a plurality of second polarized wave supply guides that supply the second polarized waves to the plurality of cross-shaped coupling apertures; and a second polarized wave distribution guide which distributes the second polarized waves to the plurality of second polarized wave supply guides.

4. The antenna of claim 3, wherein the second polarized wave supply guides and the second polarized wave distribution guide are formed on different layers.

5. The antenna of claim 3, wherein the second polarized wave supply guides are disposed in positions that correspond to an end of the first polarized wave guide.

6. The antenna of claim 5, wherein ends of the second polarized wave supply guides extend about one fourth of wavelengths of the first and second polarized waves from the end of the first polarized wave guide.

7. The antenna of claim 6, wherein widths of the second polarized wave supply guides and the first polarized wave guide are about one half of wavelengths of the first and second polarized waves, and widths of areas in which the second polarized wave supply guides and the first polarized wave guide overlap about three quarters of the wavelengths of the first and second polarized waves.

8. The antenna of claim 3, wherein first coupling slots that supply the first polarized waves to the plurality of cross-shaped coupling apertures through the plurality of second polarized wave supply guides are formed at ends of the first polarized wave guide.

9. The antenna of claim 8, wherein cross-shaped coupling slots that supply the first polarized waves and the second polarized waves to the plurality of cross-shaped coupling apertures are formed at ends of the plurality of second polarized wave supply guides.

10. The antenna of claim 1, wherein the emission unit includes, a plurality of emission cavities with a plurality of cross-shaped emission slots that emit the first and second polarized waves.

11. The antenna of claim 10, wherein the plurality of emission cavities correspond to the plurality of cross-shaped coupling apertures.

12. An antenna, comprising:

an emission unit configured to emit first and second polarized waves which intersect each other; and a supply unit configured to supply the first and second polarized waves to the emission unit, wherein the emission unit includes, a plurality of emission cavities with a plurality of cross-shaped emission slots which emit the first and second polarized waves, respectively, wherein each of the plurality of cross-shaped emission slots is formed by allowing a first emission slot through which the first polarized waves are emitted and a second emission slot through which the second polarized waves are emitted to intersect each other, and wherein the supply unit includes:

a plurality of cross-shaped coupling apertures to supply the first and second polarized waves to the emission unit, where each of the plurality of cross-shaped coupling apertures is formed by allowing a first slot through which the first polarized waves are transmitted and a second slot through which the second polarized waves are transmitted to intersect each other;

a first polarized wave guide that directs the first polarized waves to the plurality of cross-shaped coupling apertures, where the first polarized wave guide includes first coupling slots, each of which is formed parallel to a propagation direction of the first polarized waves, and the first polarized wave guide supplies the first polarized waves to the plurality of cross-shaped coupling apertures through the first coupling slots; and a second polarized wave guide that directs the second polarized waves to the plurality of cross-shaped coupling apertures, where the second polarized wave guide includes second coupling slots, each of which is formed perpendicular to a propagation direction of the second polarized waves, and the second polarized wave guide supplies the second polarized waves to the plurality of cross-shaped coupling apertures through the second coupling slots.

13. The antenna of claim 12, wherein the emission cavities each include the four cross-shaped emission slots.

14. An antenna which comprises a plurality of metal layers, comprising:

an emission layer which emits first and second polarized waves; and a supply layer which supply the first and second polarized waves to the emission layer, wherein the emission layer includes, a first emission layer with a plurality of cross-shaped emission slots which emit the first and second polarized waves, each of the plurality of cross-shaped emission slots formed by allowing a first emission slot through which the first polarized waves are emitted and a second emission slot through which the second polarized waves are emitted to intersect each other;

a second emission layer with emission cavities that correspond to the plurality of cross-shaped emission slots; and a third emission layer with cross-shaped coupling slots which supply the first and second polarized waves to the emission cavities, the cross-shaped coupling slots formed by allowing a first coupling slot through which the first polarized waves are transmitted to the emission cavities and a second coupling slot through which the second polarized waves are transmitted to the emission cavities to intersect each other, wherein the supply layer includes:

a first polarized wave guide that directs the first polarized waves to the plurality of cross-shaped coupling apertures, where the first polarized wave guide includes first coupling slots, each of which is formed parallel to a propagation direction of the first polarized waves, and the first polarized wave guide supplies the first polarized waves to the plurality of cross-shaped coupling apertures through the first coupling slots; and a second polarized wave guide that directs the second polarized waves to the plurality of cross-shaped coupling apertures, where the second polarized wave guide includes second coupling slots, each of which is formed perpendicular to a propagation direction of the second polarized waves, and the second polarized wave guide supplies the second polarized waves to the plurality of cross-shaped coupling apertures through the second coupling slots.

15. The antenna of claim 14, wherein the second polarized wave supply layer includes, a third polarized wave supply layer with a second polarized wave supply guide configured to supply the second polarized waves to the plurality of cross-shaped coupling apertures; and a fourth polarized wave supply layer with a second polarized wave distribution guide which distributes the second polarized waves to the second polarized wave supply guide.

16. An antenna, comprising:

an emission unit configured to emit a plurality of polarized waves which intersect each other, the emission unit including a plurality of emission cavities having a plurality of cross-shaped emission slots through which the plurality of polarized waves are emitted; and a supply unit configured to supply the plurality of polarized waves to the emission unit, wherein the supply unit includes, a plurality of cross-shaped coupling apertures which supply the plurality of polarized waves to the emission unit, where each of the plurality of cross-shaped coupling apertures is formed by allowing a first slot through which the first polarized waves are transmitted and a second slot through which the second polarized waves are transmitted to intersect each other;

a first polarized wave guide that directs the first polarized waves to the plurality of cross-shaped coupling apertures, where the first polarized wave guide includes first coupling slots, each of which is formed parallel to a propagation direction of the first polarized waves, and the first polarized wave guide supplies the first polarized waves to the plurality of cross-shaped coupling apertures through the first coupling slots; and a second polarized wave guide that directs the second polarized waves to the plurality of cross-shaped coupling apertures, where the second polarized wave guide includes second coupling slots, each of which is formed perpendicular to a propagation direction of the second polarized waves, and the second polarized wave guide supplies the second polarized waves to the plurality of cross-shaped coupling apertures through the second coupling slots, and wherein distances from polarized wave supply slots which supply the polarized waves to the plurality of polarized wave guides to the plurality of coupling apertures are identical.

17. The antenna of claim 16, wherein the first and second polarized wave guides are formed on different layers.

18. The antenna of claim 16, wherein the plurality of emission cavities correspond to the plurality of coupling apertures.

* * * * *